United States Patent [19]

Sivachenko et al.

[11] 4,269,055

[45] May 26, 1981

[54] LARGE PROFILE SHEET METAL CORRUGATOR

[75] Inventors: Eugene W. Sivachenko, 6471 Riverside Dr., Redding, Calif. 96001; Artemas M. Larkin, Redding; Bogdan W. Bernert, Fair Oaks, both of Calif.

[73] Assignee: Eugene W. Sivachenko, Redding, Calif.

[21] Appl. No.: 28,767

[22] Filed: Apr. 10, 1979

[51] Int. Cl.[3] ..... B21D 13/04

[52] U.S. Cl. ..... 72/180; 72/181; 29/125

[58] Field of Search ..... 72/180, 181, 701, 179, 72/182; 29/125

[56] References Cited

U.S. PATENT DOCUMENTS

| | | | |
|---|---|---|---|
| 728,020 | 5/1903 | Scherer | 72/180 |
| 865,908 | 9/1907 | Johnson | 72/180 |
| 1,588,817 | 6/1926 | Smith | 72/179 X |
| 1,936,228 | 11/1933 | Crafton | 72/180 X |
| 2,291,272 | 7/1942 | Wright | 72/179 X |
| 2,806,508 | 9/1957 | Siegerist | 72/179 X |
| 3,009,511 | 11/1961 | Le Bouef, Sr. | 72/180 |
| 3,059,685 | 10/1962 | Behlen | 72/181 X |
| 3,251,211 | 5/1966 | Harris | 72/180 X |
| 3,535,903 | 10/1970 | Abernathy et al. | 72/181 |
| 3,545,371 | 12/1970 | Reist | 72/180 |

FOREIGN PATENT DOCUMENTS

| | | | |
|---|---|---|---|
| 962436 | 12/1949 | France | 72/180 |

*Primary Examiner*—Milton S. Mehr

*Attorney, Agent, or Firm*—Townsend and Townsend

[57] ABSTRACT

A machine for forming corrugated plate from a flat sheet defined by a plurality of serially arranged corrugating stands. At least one stand has cooperating corrugating rolls defined by a plurality of disc shaped dies which, during corrugating, are rotated at differing rates so that the peripheral speed at a selected diameter, of each such disc substantially equals the linear speed of the plate being corrugated. The discs can be constructed of disc shaped die halves, the axial position of which can be varied so as to vary the corrugation pitch or the profile while maintaining the pitch constant. Drives for the corrugating rolls and, in particular, for the disc dies can power rotate all dies or only some of them while others are free wheeling. Also disclosed are an advantageous construction of the frame which establishes metal-to-metal contact between bearing blocks of the roll shafts so as to rigidify the frame while permitting ready replacement of the shafts and/or the dies; the construction of the discs of ring halves; the axial mounting of the discs to their shafts and alternative drives for the discs including planetary gear drives, internal ring gear drives, and individual drives.

33 Claims, 21 Drawing Figures

LARGE PROFILE SHEET METAL CORRUGATOR

BACKGROUND OF THE INVENTION

The present invention relates to the construction of large cold roll forming machines (hereinafter frequently referred to as "corrugator") such as are needed, for example, to produce the 6" deep×16" pitch corrugations employed in the bridge constructions disclosed and claimed in the recently issued U.S. Pat. Nos. 4,120,065 and 4,129,917.

In the past, such deep corrugations have normally been formed in large press-breaks, if they could be formed at all, as single pitch corrugated sections, i.e. U-shaped sheet metal sections defining just one corrugation and which had a length limited by the effective length of the press-break.

Up to the present the size and cost of prior art corrugators capable of cold rolling corrugated sheet metal sections having multiple corrugations of the above discussed large size were considered technically and economically impractical or unfeasible. For example, to cold roll a trapezoidal section with multiple 6" deep corrugations in accordance with the prior art would require a corrugator in which each successive stand corrugates the section at most from about 1/16 to ⅛" deep. Thus, to produce a 6" deep section in ⅛ increments would require 48 stands or more. Such a machine would be prohibitively expensive to construct, operate and maintain, and it would further require a huge and therefore very expensive building.

Since the initial cost of a corrugator is generally very high and their capacity is very large, only few, if any, manufacturers can use a given machine full time for the production of only a single profile. Accordingly, it has been common to purchase such corrugators with additional tooling so that they can produce a variety of profiles and so as to render them economically more efficient. In order to effectively utilize the additional tooling the machine must allow a fast changeover of the tooling from one profile to the next so as to maintain the machine downtimes as short as possible.

However, if a machine is constructed large enough to produce the above mentioned large corrugation profile (6"×16"), particularly in heavier metal thicknesses, the size of the rolling dies becomes very large and they become correspondingly heavy. Consequently, to change the dies of such machines from one profile to the next would not only require the disassembly of an inordinate number of rolling stands but further would require the handling of individual rolling dies which might weigh several tons each. Thus, the changeover for such a machine for rolling differing profiles becomes a major, time-consuming and, therefore, expensive and self-defeating task. These and other problems connected with cold rolling the large size corrugations renders corrugators constructed in accordance with the prior art unsuitable.

The size of any given rolling or corrugating stand is, of course, determined by the maximum size of the corrugation that is desired to be rolled, the degree of deformation that takes place at a particular stand and, therefore, the forces applied against the rolls as the metal sheet passes the stand, and the amount by which the sheet is deflected in each stand. One apparent way to reduce the enormous size of a corrugator constructed in accordance with the prior art is to increase the amount of metal deformation that takes place at each stand.

This, however, may cause the sheet to wrinkle, crack or the like, and requires the transmission of forces between the sheet and the rolls which can become very large as a result of the increased metal deformation that takes place at any given stand. Although the roll itself can be strengthened, for example, by increasing the roll and shaft diameters, a limiting factor is frequently a limit in the transmission of forces from the power-driven or power-rotated rolls to the sheet since such forces can only be transmitted by friction.

Ideally, the speed of each roll equals the speed of the sheet past the corrugating stand. In such an event there is no slippage and a maximum transmission of forces. Practically, however, this cannot take place because in profile the corrugating rolls have varying diameters. In the above example of a 6"×16" corrugation profile the rolls have maximum and minimum diameters which differ by 12". When the rolls are power-driven the peripheral or surface speeds between the largest and the smallest roll diameters may vary by as much as 20% or more. Thus, in actuality the peripheral speed of the rolls equals the speed of the sheet past the corrugating stands at only one roll diameter. At all other diameters of the rolls the peripheral speeds differ from the speed of the sheet.

The differences between the surface speeds of the sheet and of the rolls results in slippage; portions of the sheet will typically travel faster than parts of the rolls and other portions will travel slower. For conventional, shallow, e.g. 1" to 2" deep corrugations and relatively thin plates such slippage can be tolerated, if necessary by adding corrugation stands and thereby reducing the forces that are applied at each of them. However, for deep corrugations and/or thick plates slippage makes it difficult if not impossible to effectively transmit the large forces that are required to corrugate the sheet in large increments and in a relatively few corrugating stands. Even more seriously, the relative motion between the rolls and the sheet, coupled with the necessary large forces would subject the rolls to extreme wear and galling, thereby not only damaging the rolls and rendering very expensive equipment useless but further damaging the surface of the sheet.

Additionally, when portions of the sheet travel faster and other portions slower than corresponding portions of the rolls, the top and bottom portions of the corrugated sheet, i.e. the corrugation peaks and troughs are subjected to severe forces and resulting bending moments caused by this difference in the relative speeds between the sheets and the rolls. These forces and moments tend to warp and bend the sheet and they can skew it, that is deflect it from a straight travel path perpendicular to the axes of the rolls to one or the other side. Moreover, the relatively weak corrugation sides interconnecting the corrugating peaks and troughs can become wrinkled, resulting in the so-called "oil canning effect", particularly when the sheet is relatively thin. Thus, a sheet corrugated in this manner is likely to be warped, dimensionally inaccurate, wrinkled and, for many applications, useless.

In a typical example for forming 6"×16" trapezoidal corrugations the neutral axis of the sheet and of the roll dies is spaced 3" from the top and bottom flanges of the corrugated sheet. Assuming the neutral axis of the sheet to travel linearly at a speed of 50' per minute and a roll die having an outermost (peak) diameter of 30" and an opposing innermost (trough) diameter of 18", the peripheral speed of the crown diameter is 62.50′ per minute or 25% faster than the peripheral speed of the neutral axis of the roll. Similarly, the trough diameter of the roll die has a peripheral speed of 37.50′ per minute or 75% of the peripheral speed of the peak diameter of the roll. In other words, at the stated diameters there is an approximately 67% difference in the peripheral speed between the maximum and the minimum die diameters. This, therefore, results in a 67% relative speed differential between the maximum and minimum roll die diameters and the sheet being corrugated.

Such a difference is too large for producing an acceptable product free of galled surfaces, wrinkles and the like. The difference in peripheral speeds is especially critical when producing trapezoidal patterns (as opposed to making a sinusoidal pattern where the male dies do not need an opposing female die to produce the correct radius at the crowns), since a male or peak die for a trapezoidal pattern must cooperate with a corresponding, opposing female or trough die in order to exert the relatively much greater forces and form the necessary, sharply radiused corners between flat crown or trough sections of the corrugation and the interconnecting slanted corrugation sides.

The forces and particularly the moments generated by the speed differences not only adversely affect the dimensional stability and ultimate shape of the corrugated sheet but, in addition, they build up forces which must be borne by the structural frame of the corrugator, the bearings, the dies and the like which in turn requires that these be given sufficient strength to withstand such forces. This, in turn, increases the overall cost of the corrugator.

As has been demonstrated in the earlier referenced, recently issued U.S. patents, by carefully analyzing and selecting the actual dimensioning of corrugated plate significant advantages can be attained in the strength, weight and cost of the ultimate structure into which the corrugated plate is assembled or installed. To mention a few parameters, the base width of the corrugation peaks and valleys can be varied by slight amounts so as to enable a true nesting of corrugated sheets which facilitates both the ultimate use of the sheet and their storage and shipment by minimizing the volume occupied by a stack of such sheets. Further, the relative width of the corrugation peaks and/or crowns can be varied to maximize the section modulus or moment of inertia of a given structure while minimizing its weight. For similar considerations it is frequently desirable to vary the metal thickness of various corrugated plate components in a corrugated plate structure.

Each time any one of these parameters of a corrugated plate is changed, it is necessary to correspondingly change the roll dies for the plate since effective rolling and an accurate dimensioning of the corrugated plate requires that the spacing between the opposing dies of every corrugating stand substantially equals the desired profile of the plate at the particular stand. This is especially true for the last two stands which determine the ultimate dimensioning and shape of the plate.

Each time the shape of the profile is changed, whether or not this involves a change in the corrugation pitch, it is necessary to install an entirely new set of roll dies in corrugators constructed in accordance with the prior art. This can even be true when the only change is the plate thickness since a mere increase in the spacing between cooperating dies does not correctly change the spacing between the die peripheries. To illustrate the point, if the plate thickness is increased by a given amount and the spacing of cooperating dies is increased by the same amount, the correct distance between the die peripheries can only be obtained for some portions of the corrugated plate, say at the flat and parallel corrugation peaks and troughs. The spacing between the die peripheries for the slanted corrugation sides will be greater than necessary for the changed plate thickness. This, in turn, permits portions of the plate to be loose as it passes between the dies which contributes to dimensional instabilities in the finish corrugated plate.

Thus, for prior art corrugators it is necessary to provide a separate set of dies for each contemplated corrugation profile. The same applies for each contemplated metal thickness although there one can compromise to a certain degree as briefly outlined in the preceding paragraph if one is willing to accept a degree of dimensional instability of the finished product. However, it is apparent that a large number of roll dies are necessary if one desires to take advantage of efficient corrugated plate forms and dimensions. This greatly increases the initial tooling cost for the corrugator and further greatly increases its operating costs because of the need to change heavy dies each time a different profile and/or a different plate thickness is being corrugated.

Apparently, as a result of these large costs, it has heretofore not been the practice to design corrugated plate shapes and to dimension the plate to optimize the efficiency of such plate in the ultimate structure into which it is assembled or installed. Instead, manufacturers have simply manufactured one or two standard plate profiles and dimensions and offered these for sale. It was then left to the engineer to incorporate these profiles to the best of his ability, knowing that he had to compromise structural efficiency of the profiles in order to obtain them at an economically feasible cost.

SUMMARY OF THE INVENTION

The present invention greatly reduces or eliminates the shortcomings of prior art corrugators discussed above by providing a corrugator having at least one and normally having several corrugating stands, including the last corrugating stand, in which the corrugating rolls are constructed of multiple, independently rotatable disc shaped roll dies which, during the corrugation of a flat plate into a corrugated plate, rotate at differing rates so as to more closely approximate the peripheral speed of the various roll dies with the linear speed of the plate being corrugated. There is, therefore, much less slippage between the roll dies and the plate than was heretofore the case so that much greater forces can be transmitted from the rolls to the plate. As a result, the plate can be deformed in much greater increments than was heretofore the case and the corrugator as such needs relatively few corrugating stands. For example, for corrugating 6″×16″ corrugations the corrugator may have as few as 5 to 7 corrugating stands as compared to up to 48 stands or more for corrugators constructed in accordance with the prior art while enabling the corrugation of plate having thicknesses much greater than could heretofore be corrugated.

Another aspect of the present invention contemplates to construct each disc shaped die of a plurality, e.g. two die halves carried on a shaft side by side and interconnected so that the relative spacing between the die halves can be varied. In this manner, the profile of a corrugated plate can be changed, e.g. the peak can be widened while the adjacent trough is narrowed without changing the corrugation pitch and without requiring a replacement of the dies as was heretofore the case. Further, to accommodate variable plate thicknesses, the spacing between the dies can be varied according to the difference in the plate thickness while the spacing between die halves can be adjusted so as to maintain an exact spacing between the die peripheries even at the sloping corrugation sides. As a result, the finish corrugated plate is dimensionally accurate and its shape can be readily varied without the need for separate die sets for each different profile and without the need for having to replace such large dies each time a new profile and/or different metal thickness is being rolled. Thus, the present invention greatly reduces tooling and operating costs for corrugators while it enhances the dimensional stability of corrugated plate.

Generally speaking, a corrugator constructed in accordance with one embodiment of the present invention has a frame and a plurality of serially arranged corrugating stands each of which includes a pair of cooperating corrugating rolls. At least the last (or downstreammost) stand, and preferably the downstreammost stand and at least one additional stand immediately upstream therefrom have a pair of corrugating rolls defined by spaced apart, parallel first and second shafts and a plurality of generally disc shaped rolling dies carried on each shaft. The last two stands can have identical dies to dimensionally stabilize the corrugated sheet in the manner generally discussed in U.S. Pat. No. 3,009,511.

The rolling dies are axially arranged over a portion of the length of each shaft and they alternatingly define a relatively large diameter, convex rolling die (hereinafter sometimes "male die" or "male disc") and an adjacent, relatively smaller diameter concave rolling die (hereinafter sometimes "female die" or "female disc"). These dies cooperate with opposing but identically shaped relatively small diameter concave and relatively large diameter convex rolling dies, respectively.

At least some of the dies, and preferably at least the large diameter convex rolling dies on one of the shafts of such stands are power rotated so that a sheet to be corrugated can be grasped by opposing roll dies of these stands. Once so grasped the power rotated roll dies frictionally engage the plate and advance it in a downstream direction while causing the desired deformation of the profile of the sheet as it passes between the rolls. Means is further provided for rotating at least some of the roll dies on the shafts of these stands at differing rates which take into account differences in the diameters of the dies so that a peripheral speed of each convex die at a first diameter and a peripheral speed of each concave die on a second, different diameter are substantially equal to the speed with which the plate passes the stand.

Preferably, this is accomplished by power rotating both shafts of each stand and keying the large diameter convex roll dies to the shaft. The other roll dies are mounted to the shafts with suitable journal bearings for rotation relative thereto. Dies rotationally mounted to the shaft can be freewheeling, that is they are not power rotated so that their rate of rotation is reduced by the sheet travelling past them. Alternatively, and particularly for instances in which the incremental deformation of the sheet at a stand is relatively large, the plate is relatively thick, and/or the material of the plate is difficult to deform, e.g. is a high yield steel, some or all of the roll dies which are rotatably mounted to the shaft are power rotated at the required rate of rotation so that a portion of each die has a peripheral speed which substantially equals the linear travel speed of the plate.

Thus, the present invention provides a corrugator having at least one stand in which each corrugating roll is divided into a plurality of axially spaced roll dies which are rotated at differing speed so as to significantly reduce slippage between the dies and the plate travelling past the stand. With the reduction in the slippage, it is not only possible to increase the forces that can be transmitted between the dies and the sheet, but wear and tear of the sheet and of the rolls is reduced. In a preferred embodiment of the invention in which the finish corrugated plate has a trapezoidal profile defined by parallel, spaced apart corrugation peak sections and corrugation trough sections which are interconnected by slanted corrugation sides, the convex crown dies mounted to one of the shafts and the cooperating, opposing, concave trough dies are power rotated so that their peripheral speed at their largest and smallest diameters, respectively, that is the portions of their periphery which define the peak and trough sections, have peripheral speeds which equal the linear speed of the plate. Since maximum forces are transmitted between the dies and the plate at the curved transition between the peak and trough sections and the slanted corrugation sides, and since these curved transitions are very close to the above discussed maximum and minimum diameters of the convex and concave dies, respectively, there is very little, if any, slippage at the transitional areas. It is, therefore, possible to transmit much larger forces than was heretofore possible without galling or otherwise damaging either the dies or the plate being corrugated.

Since the peripheral speed of the dies at both the corrugation peak sections and trough sections equals the plate speed, the maximum differential speed between other portions of the dies and the sheet takes place in the vicinity of the neutral axis of the plate, that is at the corrugation sides. During the corrugating of plate the forces applied to the sides are relatively small so that a galling of either the plate or the dies is effectively prevented. Further, since the peripheral die speeds and the plate speed coincide at the corrugation peaks and troughs the heretofore troublesome large forces and resulting moment arms, which could cause the warping or skewing of the finish corrugated plate as well as the earlier discussed wrinkling of or oil-canning effect on the corrugation sides, are eliminated. Consequently, a plate corrugated in accordance with the present invention will be flat, straight, dimensionally accurate and free of surface blemishes.

As a refinement, particularly adapted for relatively deep corrugations, one or more additional roll dies may be interposed between proximate convex and concave dies. These additional roll dies are also rotatably mounted to the shaft and they may either be freewheeling or power rotated, as a particular application may require. If the additional dies are freewheeling, their rate of rotation is again induced by the travelling plate and will be such that the peripheral speed of the additional dies at one diameter coincides with the linear speed of the plate. If the additional dies are power rotated their rate of rotation is selected to obtain the same result.

This aspect of the present invention further provides advantageous manners of mounting the roll dies, biasing them towards each other and maintaining them at the desired relative position on the shaft, and for power rotating them. The latter aspect may include means for varying the rate of rotation of the dies which are rotatably mounted to the shaft through suitable gearing. For purposes of this application and the appended claim "gearing" is understood to include conventional gear trains, chain and sprocket drives as well as drives which function in a similar manner.

In another embodiment of the present invention, the earlier discussed cooperating upper and lower corrugating rolls are constructed of a number of individually mounted corrugating discs which have parallel axes of rotation but which may be axially aligned or offset. In this embodiment, each roll is defined by a set of independently mounted discs. Each disc is mounted to a support which is in turn carried by the frame. Each disc may be either power driven at a rate so that its peripheral speed (at the point of maximum forces acting between the disc and the sheet being corrugated) coincides with the linear speed of the sheet past the disc or it may be freewheeling so as to accomplish the same result. This embodiment of the invention is attractive insofar as the disc mounting shafts are relatively short. Thus, the bending moment to which the shafts are subjected are small so that the shafts can be of a much smaller diameter. Further, the discs are readily interchanged if and when that is required.

Another aspect of the present invention provides that the dies and specifically the convex and concave roll dies be constructed of a pair of axially spaced apart die halves which are interconnected with bolts or the like that permit their spacing to be changed. In this manner, the pitch or the profile being corrugated can be changed (while maintaining a constant pitch) without having to replace the dies. As a result, one set of dies can be employed for all profiles of a given pitch. This aspect of the invention is particularly useful for applications where the corrugations must nest so that the corrugation peak of one plate bottoms out in the trough of the other plate. As is discussed on the above-referenced U.S. patent this can be accomplished by alternatingly giving the peaks and troughs slightly differing base widths (without changing the overall corrugation pitch) to take the material thickness of the plate into consideration.

The axial adjustability of the roll dies also permits a precise adjustment of the dies to accommodate differing plate thicknesses (without varying the base width or the pitch). To adjust the dies for a different plate thickness the opposing die sets are moved towards or away from each other so that opposing sets of cooperating convex and concave roll dies have a spacing equal to the plate thickness. The die halves are further moved in an axial direction towards or away from each other by adjusting the bolts so that the spacing of the roll dies defining the corrugation sides also equals the desired plate thickness. Consequently, with a simple adjustment, plates of differing thicknesses can be rolled while the dies firmly engage, deform and guide the entire plate over its entire width. As a result, play of the plate between inaccurately spaced portions of the dies, as encountered in the prior art and the resulting warping, skewing and dimensional instability of the plate, as well as the need for a separate set of dies for each profile and/or plate thickness are eliminated.

This aspect of the present invention further contemplates to construct each die half of a disc member which is carried by the shaft and to which a die or corrugating ring is applied. While the disc member can be constructed of relatively inexpensive carbon steel, for example, the outer rings which are subjected to the greatest forces and, consequently, to the greatest wear and tear can be made of hard and wear-resistant (but relatively expensive) alloy steels and like materials. The rings can be readily replaced with new ones without incurring the expense of replacing an entire roll die, thereby significantly reducing both the initial cost of the dies and their subsequent maintenance and replacement costs. Large diameter dies can further be constructed in the form of a modular wheel comprising a hub, a rim and interconnecting spokes defined by wheel halves that are bolted together and to which the corrugating ring is in turn secured. This arrangement greatly facilitates the replacement of dies without having to remove the supporting shaft from the frame.

From the foregoing, it should be apparent that the present invention provides a corrugator particularly adapted for efficiently forming deep corrugations in relatively thick plate. Heretofore, such plate could only be formed in individual sections comprising less than one full corrugation in a time-consuming and expensive press-breaking process. Instead, such plate can now be continuously rolled from coils of flat steel at very high speeds so that the manufacturing cost for such plate is greatly reduced. Moreover, the present invention enables the efficient use of such corrugators by making the roll dies adjustable so as to produce with one and the same set of dies differing profiles as well as plate having differing thicknesses.

While the invention thus reduces manufacturing costs through a significant increase in the output capacity of a corrugator and greatly enhances the versatility of such corrugators by enabling them to form differing profiles, the corrugator as such is significantly simplified and specifically its size is reduced to a fraction of what was heretofore though necessary to form corrugations of the size here contemplated.

Consequently, the present invention makes it possible to optimize corrugated plate shapes, dimensions and thicknesses to suit each particular application, to minimize material consumption and production costs while maximizing the efficiency with which the material is used. The present invention thereby makes it feasible to produce components for high load carrying structures (such as are disclosed in the earlier referenced U.S. patents) on an economical basis and thus helps the public at large to take advantage of the benefits afforded by such structures.

DESCRIPTION OF THE PREFERRED EMBODIMENT

Figure 1:
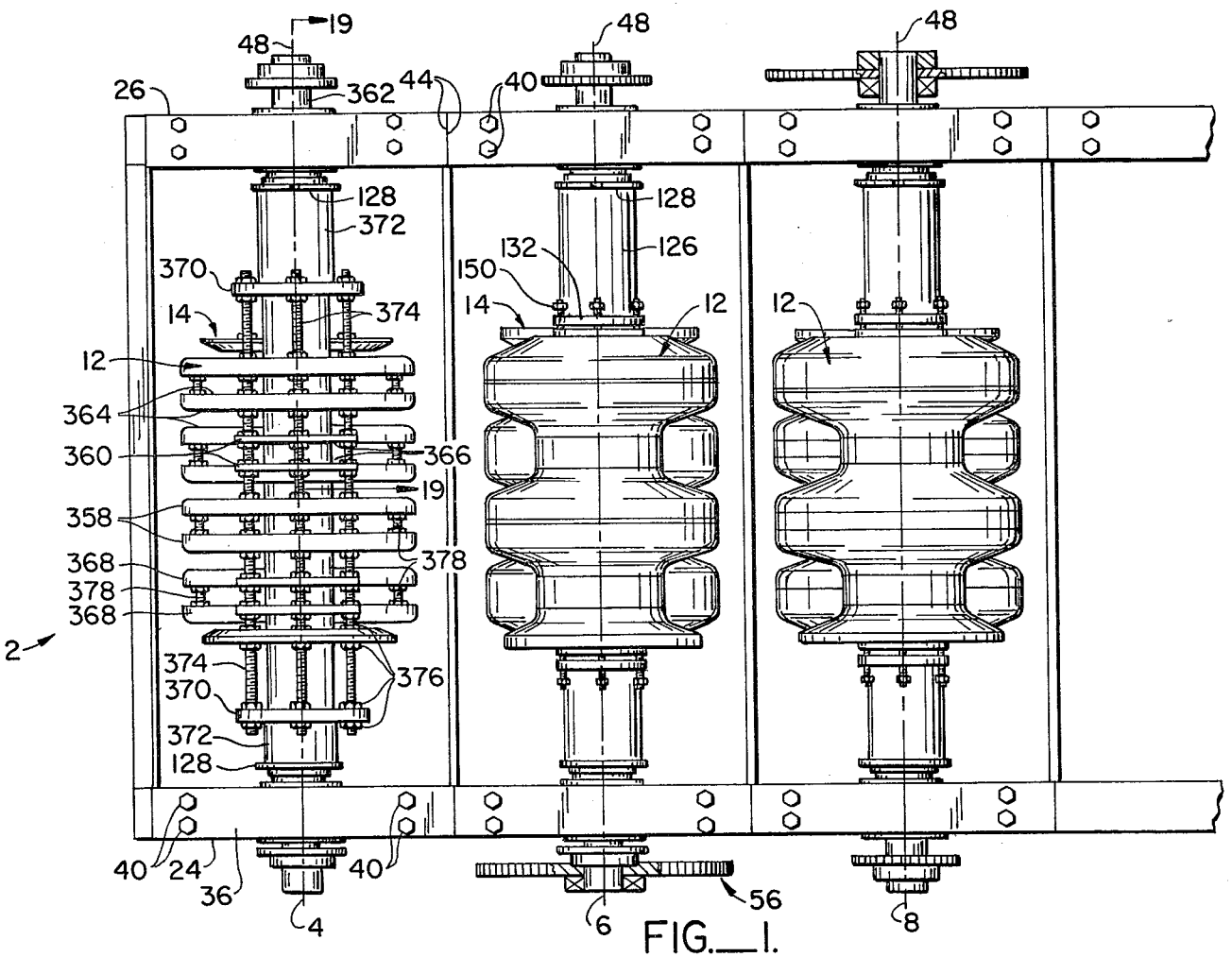
FIG. 1 is a fragmentary schematic plan view of a corrugator constructed in accordance with the present invention.
Figure 2:
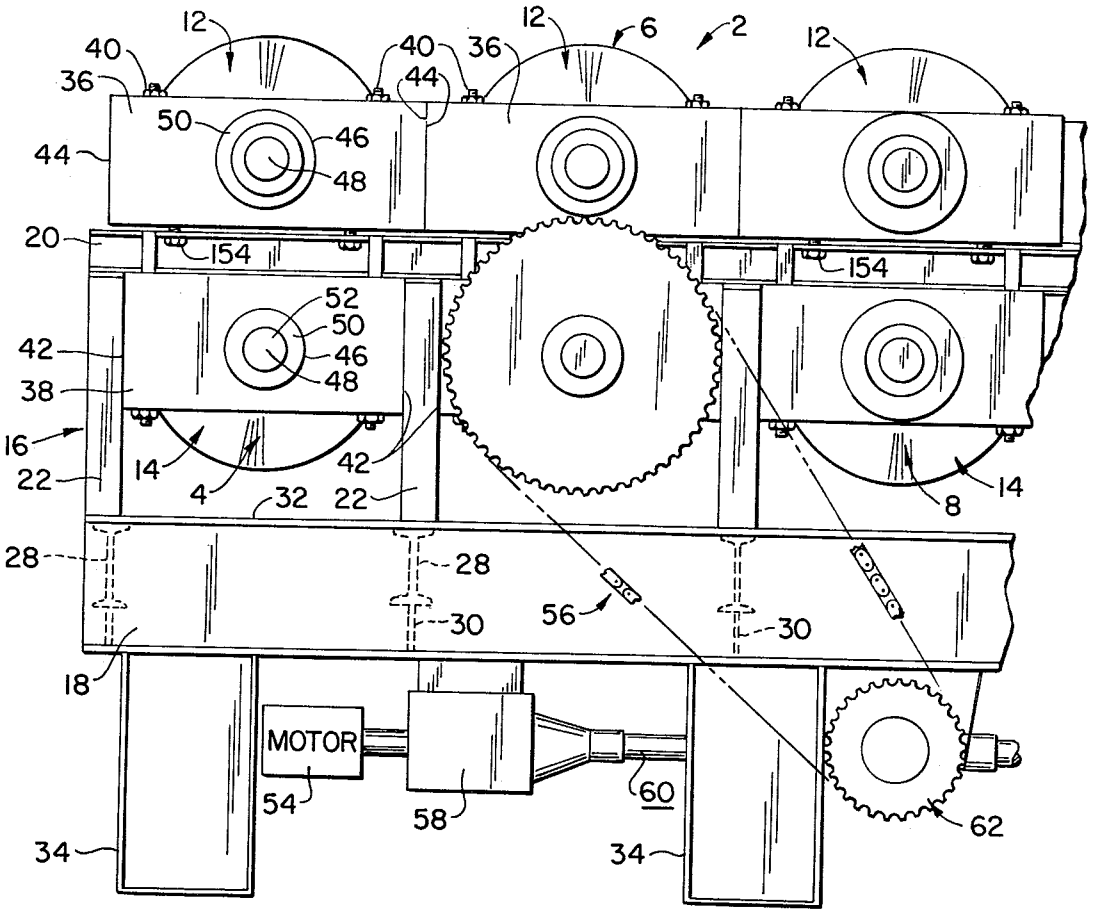
FIG. 2 is a fragmentary side elevational view of the corrugator illustrated in FIG. 1.

FIGS. 1 and 2 generally illustrate a roll forming corrugator 2 constructed in accordance with the present invention. It has a plurality of serially arranged corrugating stands, say seven or ten; however, only the last three stands of the corrugator, a last stand 4, a second to last stand 6 immediately upstream of the last stand, and an additional stand 8 are illustrated. Typically, the corrugator includes at its upstreammost or intake end (not shown) a pinch roll stand (not shown) which initially contacts a flat plate (not shown) that is to be corrugated and which feeds the plate towards and into the first corrugating stand (not shown). The plate continues in a downstream direction towards the last stand 4 and each time it passes a corrugating stand it is deformed by an additional increment so that the initially flat plate becomes a finish corrugated plate when it issues from the last stand.

Each corrugating stand is defined by a pair of opposing, normally upper and lower corrugating rolls 12, 14, which are rotatably mounted to a corrugator frame 16. Although the present invention relates especially to the construction and operation of the corrugating rolls, it also provides an advantageous overall arrangement of the frame and associated structures which greatly enhances the strength and rigidity of the corrugator.

Still referring to FIGS. 1 and 2, the frame generally comprises a weldment of a pair of relatively large, lower, longitudinally extending beams 18 and a pair of smaller, upper longitudinal beams 20. Upright stanchions 22 on both sides 24 and 26 of the corrugator connect the upper beams 20 with the lower beams 18.

The lower beams 18 are secured to each other by intermittently placed traverse beams 28, gussets 30 and a heavy bed plate 32. The lower beams rest on vertical supports 34 conventionally anchored to a concrete base or floor (not shown).

An upper bearing block 36 and a lower bearing block 38 for the upper and the lower rolls 12, 14, respectively, of each corrugating stand are mounted on top of and beneath, respectively, the upper horizontal beams 20. Preferably, two relatively long, threaded bolts 40 positioned on each side of the bearing stand extend vertically through aligned apertures in the bearing blocks and the upper horizontal beam. The bearing blocks are firmly drawn against the beam with nuts threaded onto the bolts.

The lower bearing blocks have sides 42 which abut against stanchions 22 while the upper bearing blocks 36 have sides 44 which abut against each other to establish metal-to-metal contact between the bearing blocks over the entire length of the corrugator so as to rigidify the frame and enable it to withstand large forces acting in the travel direction of the plate through the corrugator. Each bearing block includes an aperture 46 aligned with the axis 48 of the associated corrugation roll and which receives a bearing 50 for rotatably mounting roll shafts 52.

Depending on the required force that is exerted by the rolls of each stand, one or both rolls are driven. For example, a motor 54 may be provided which drives a chain drive 56 for the rolls via a transmission 58, shafting 60 and suitable bevel gearboxes 62. For simplicity, only one chain drive for driving the lower roll 14 of stand 6 is illustrated. Typically, however, there is a chain drive for each stand and both the upper and the lower rolls are driven by providing a second chain drive for the upper roll or by suitably gearing the upper and lower rolls to each other. This aspect of corrugators is well-known and, therefore, not further illustrated or described herein.

Figure 13:
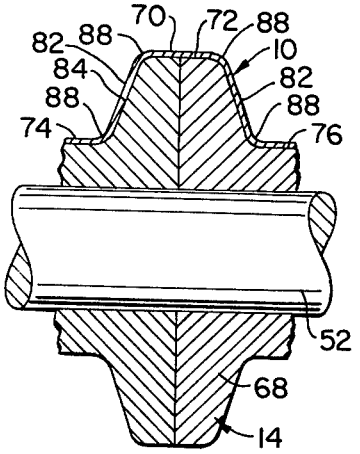
FIG. 13 is a front elevational view, in section, and is taken on line 13—13 of FIG. 12.

Referring to FIGS. 1, 2, 12 and 13, a flat plate (not shown) to be corrugated is fed in a downstream direction, that is to the left as viewed in FIGS. 1 and 2, towards downstreammost corrugating stand 4. In each stand, the initially flat plate is deformed by an additional increment. For the above indicated reasons, the last two stands, i.e. stands 4 and 6, may have corrugating rollers which have a substantially like shape and setting so as to facilitate the production of corrugated plate which is accurately shaped and dimensioned. Assuming the finish corrugated plate 10 to have a trapezoidal cross-section as illustrated in FIG. 13, the corrugating rolls 12, 14 of that stand have a corresponding profile as is best seen in FIG. 13 (where only the lower roll 14 is illustrated). The corrugating roll is rotated at a given speed; for one piece prior art corrugating rolls that speed is typically selected so that the peripheral speed of the roll at the neutral axis 64 (indicated by a broken circle 66 in FIG. 12) coincides with the linear speed of the plate 10. As the (not yet finish) corrugated sheet contacts a (two-piece) rolling die 68 of the corrugating roll, a peak 70 of the plate contacts crown 72 of the rolling die at the same time as a trough 74 of the plate contacts a corresponding trough portion 76 of the die at points 78 and 80, respectively, on the periphery of the die. Slanted corrugation sides 82 interconnecting the corrugation peaks and troughs 70, 74 include the neutral axis 64 of the corrugated plate and contact correspondingly slanted die surfaces 84. The neutral axis of the corrugated plate contacts the die at point 86.

When roll die 68 is keyed to roll shaft 52 it rotates at a constant speed with the shaft. In the past, the rate of rotation of the shaft was typically selected so that the peripheral speed of neutral axis circle 66 coincides with the linear speeds of corrugated plate 10 and, therefore, there is no relative motion between the corrugated plate and the die at neutral axis contact point 86. The peripheral speed of die crown 72 exceeds the linear speed of the corrugated plate while the peripheral speed of die trough 76 is less than the linear speed of the plate. THus, there is relative motion between the plate and the die at all diameters of the die which come in contact with the plate except for the neutral axis diameter 66.

It is apparent that this differential speed increases with the distance of any given circle from the neutral axis circle. Thus, the deeper the corrugation the greater is the differential speed or slippage between the plate and the inner and outermost diameters of the die. As a result of this slippage, it is difficult to transmit the necessary forces from the power rotated die to the plate to propel the plate through the dies and deform it to the desired shape.

Further, maximum forces are transmitted from the dies to the plate at the curved transitions 88 of the corrugated plate intermediate the corrugation peaks and troughs and the slanted corrugation sides. At these points, however, the difference in the surface speeds of the contacting portions of the plate 10 and the dies 68 is greatest, resulting in a great deal of slippage between the dies and the plate which, due to the large forces applied in these areas, can score or scratch the sheet and gall the die, resulting in an inferior or unusable end product and a rapid wear and deterioration of the dies. Because of the problems summarized in the preceding paragraphs, the cold roll forming of corrugated plate having deep corrugations has heretofore not been successfully practiced on a commercial scale.

Figure 4:
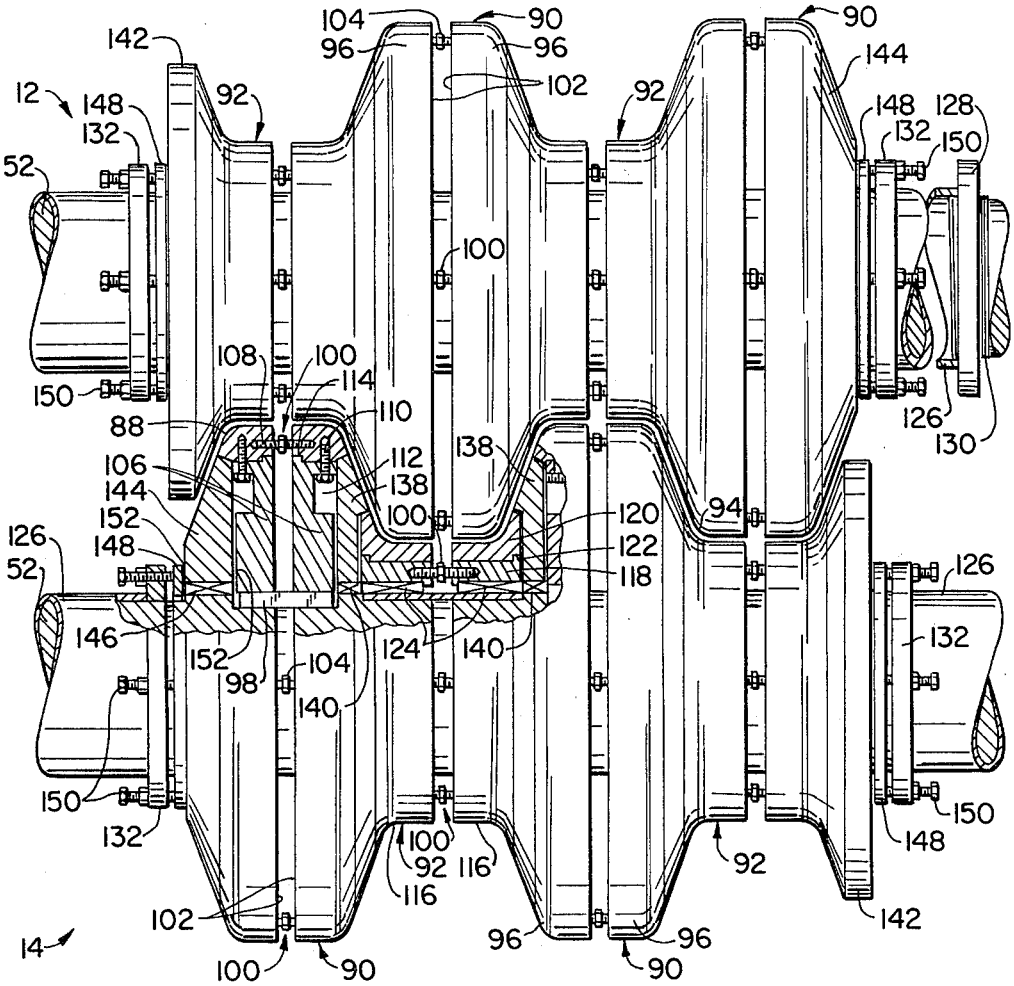
FIG. 4 is an enlarged, fragmentary, front elevational view of opposing corrugating rolls constructed in accordance with the present invention and having axially spaced roll dies which rotate at differing rates.

Referring now to FIGS. 1, 2 and 4, to overcome these problems and to avoid excessively large differences in the surface speeds between the dies and the plate, the present invention contemplates to construct at least those corrugating rolls 10, 12 at which (a) the corrugation depth is at a maximum and (b) the forces developed between the corrugating rolls and the sheet being corrugated are greatest so that portions of the rolls have differing surface speeds. Typically, the affected corrugating stand will be the downstreammost stands, say the last two or three stands 4, 6 and 8 of the corrugator illustrated in FIGS. 1 and 2. It should be noted that the construction of the corrugating rollers of the last corrugating stand 4 shown in FIG. 1 may differ from that of the corrugating rollers at stands 6 and 8 in a manner further described below.

Instead of constructing the corrugating rolls of one piece with the corrugating shaft, or of individual, disc-shaped corrugating dies keyed to the roll shaft, the present invention divides a corrugating roll into at least three components, the roll shaft 52, one or more large diameter, axially spaced apart, convex or male corrugating dies 90, and a corresponding number of relatively lesser diameter, concave or female dies 92 disposed between adjoining male dies. The male and female dies on cooperating roll shafts 52 are staggered so that each male die on one shaft cooperates with a corresponding female die on the other shaft and the dies define between them an open space 94 which has a profile that corresponds to the desired profile to which the plate (not shown in FIG. 4) is corrugated in the corrugating stand in question. For the last corrugating stand, the shape and dimensions of the open space substantially coincide with the desired profile of the finish corrugated plate.

In the preferred embodiment, each male die is constructed of adjoining male die halves 96 which have an exterior surface that corresponds to the desired plate profile at that stand. Each die half is secured to shaft 52 with keys 98 so that the die halves are power rotated with the shaft. Equally spaced bolts 100 having left and right hand threads are threaded into opposing faces 102 of the male die halves. A nut portion 104 is provided for engaging the bolts with suitable wrenches (not shown) so that they can be rotated in one or the other direction to thereby draw the die halves together or spread them apart so as to enable the precise adjustment of the die halves as is further set forth below.

In a preferred embodiment of the invention the male die halves are defined by inner discs 106 which are keyed to shaft 52 and an outer die ring 108 that is secured to the discs with radially oriented bolts 110 disposed in disc recesses 112. The disc may be constructed of conventional carbon steel while the outer rings are constructed of appropriate alloy steel so as to minimize the wear of the dies in the vicinity of the curved transition 88 and facilitate the replacement of the rings if and when they are worn. Preferably, each inner die disc includes adjacent its face 102 a radially outwardly protruding lip 114 which engages a corresponding groove in the ring and locks the rings to the discs to resist relative axial motion between the two when the rings are subjected to large axially acting forces while plate is being corrugated. To maintain the rings in place at all times, bolts 100 are threaded into the rings.

The female dies 92 are similarly constructed of opposing female die halves 116 defined by inner discs 118 which receive outer female die rings 120. Left and right hand threaded bolts 100 again secure the female die halves to each other. To prevent the spreading of the female die halves during corrugating, the female discs include radially protruding lips 122 which engage corresponding grooves in the female die rings. The draw bolts 100 are threaded into the discs to prevent them from being spread apart during corrugating.

Unlike the male die halves 96, the female die halves are rotatably mounted to shafts 52 with suitable bearings 124 (such as needle bearings) so that the female dies can rotate relative to the shaft as well as relative to the male dies (which are keyed to the shaft).

The embodiment of the invention shown in FIG. 4 additionally includes an intermediate or third roll die 138 which is interposed between adjacent male dies 90 and female dies 92. The intermediate die is shaped so that it contacts a portion, e.g. most of the corrugation side between the corrugation peaks and corrugation troughs. The intermediate die is also rotatably mounted to shaft 52 with a journal bearing 140.

Since the sides of a finish corrugated plate typically end at the corrugation sides, cooperating male and female end dies 142, 144 are further provided. The end dies are contiguous with female and male dies 92, 90, respectively, and they again form surfaces for contacting the slanted corrugation sides of the corrugated plate. The end dies are rotatably mounted to shaft 52 with journal bearings 146. A retaining ring 148 together with axially oriented adjustment bolts 150 threaded into an adjustment flange 132 engage the face of each end die 142, 144 and biases them against corresponding sides of the female and male die discs 118, 106, respectively, as described below. To minimize friction between the end dies, the retaining rings and the corresponding faces of the discs, suitable thrust bearings 152 are interposed. The thrust bearings may comprise bronze or brass ring bearings, a bronze, brass or the like coating on the contacting faces, needle bearings or the like.

To position the male and female dies 92, 94 in an axial direction on shafts 52, end sleeves 126 are provided. They extend from adjustment nuts 128 located proximate shaft bearings 50 (see FIG. 2) and threaded onto threaded portions 130 of shaft 52 to the adjustment flanges 132 carried on and rotating with shafts 52. Upon the tightening of adjustment nuts 128, the roll dies on shaft 52 are biased towards each other and the relative position of the dies on the shaft is fixed. The biasing force from the nuts is transmitted to the dies via sleeve 126, flange 132, bolts 150 and retaining ring 148. It should be noted that the relative position of the dies on the shaft can be varied, for example to align the dies with the relative position of the dies on adjoining corrugation stands by appropriately adjusting the adjustment nuts 128.

The operation of the corrugator illustrated in FIGS. 1, 2 and 4 as so far described can be briefly summarized. Initially, the vertical position of upper and lower corrugating rolls 12, 14 is adjusted by loosening the threaded bolts 40 so that the lower bearing blocks 38 can gravitationally move downward of horizontal beam 20. The vertical position of upper bearing blocks 36 is adjusted with adjustment bolts 154 threaded into the horizontal beam while shims (not separately shown) are placed between the upwardly facing side of the lower bearing blocks and the beam. Upon the re-tightening of bolts 40 the upper and lower bearing blocks and therewith the upper and lower corrugating rolls 12, 14 are placed in the desired relative vertical position.

Figure 3:
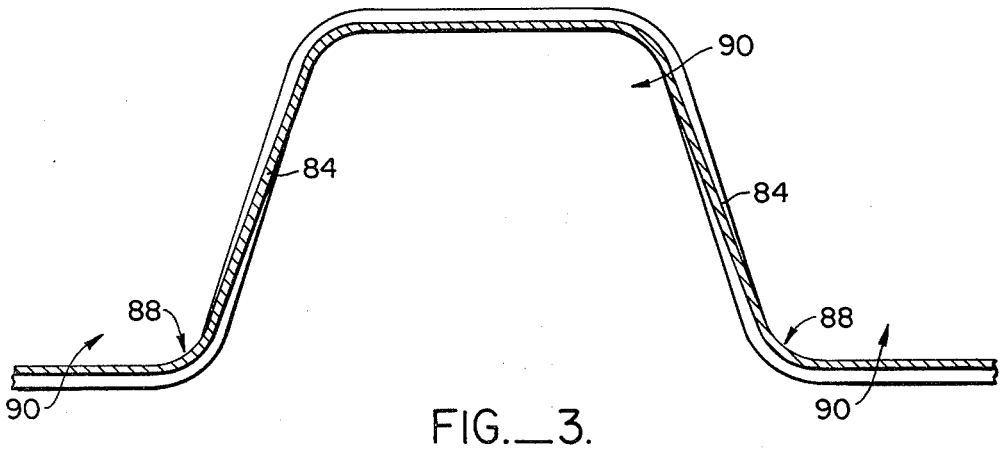
FIG. 3 is a schematic illustration of the space between the peripheries of opposing, cooperating forming rolls.

Adjustments in the relative lateral positions of the corrugating rolls, and particularly of the corrugating dies 90, 92 is normally limited to adjustments required due to differences in the thickness of the plate being corrugated. When the relative lateral position of the male and female dies 90, 92 is set for a given plate thickness the plate completely fills space 94 between the upper and lower corrugating rolls. If, however, plate having a lesser thickness is to be corrugated, open space 94 between the corrugating rolls is larger than necessary. As a result, the plate being corrugated will not fill the entire space but will engage only the male dies 90 while the slanted corrugation sides 84 will contact the correspondingly slanted sides of the dies only in the vicinity of the radiused portions 88 as is schematically illustrated in FIG. 3. Unless proper adjustments are made the finish corrugated plate will be dimensionally unstable, may exhibit wrinkles, etc.

To overcome this, the vertical position of the upper and lower corrugating rolls is adjusted as above described. Further, the male die halves 96 and the intermediate dies 138 are spread apart while the female die halves 116 are correspondingly drawn together by correspondingly adjusting threaded bolts 100 until the play between the slanted corrugation sides 84 and the corresponding slanted die sides has been taken up. At that point, the open space 94 between the corrugating rolls has been narrowed in its entirety to conform to the lesser metal thickness. The same operation is reversed if plate of a greater thickness is to be corrugated.

The above-described adjustment results in an adaptation of the corrugating rolls to corrugate different plate thicknesses without the adverse effects encountered when there is play between the rolls and the plate being corrugated. The pitch, that is the axial distance between one male or female die and the next adjacent male or female die, however, remains constant.

The present invention also permits a changing of the pitch by correspondingly increasing or decreasing the spacing between the die halves of each male and female die 90 and 92 within the limits established by die positioning nuts 128 on roller shafts 52. It should be noted, however, that the change in the pitch does not alter the slope of the slanted corrugation sides 84; rather, it results in a corresponding increase in the width of the corrugation peaks and troughs.

Further, the adjustability of the die halves can be employed to increase the relative width of either the corrugation peaks or the corrugation troughs by correspondingly decreasing the width of the other without affecting the corrugation pitch. In this manner, the plates can be rendered truly nesting as above discussed.

Figure 5:
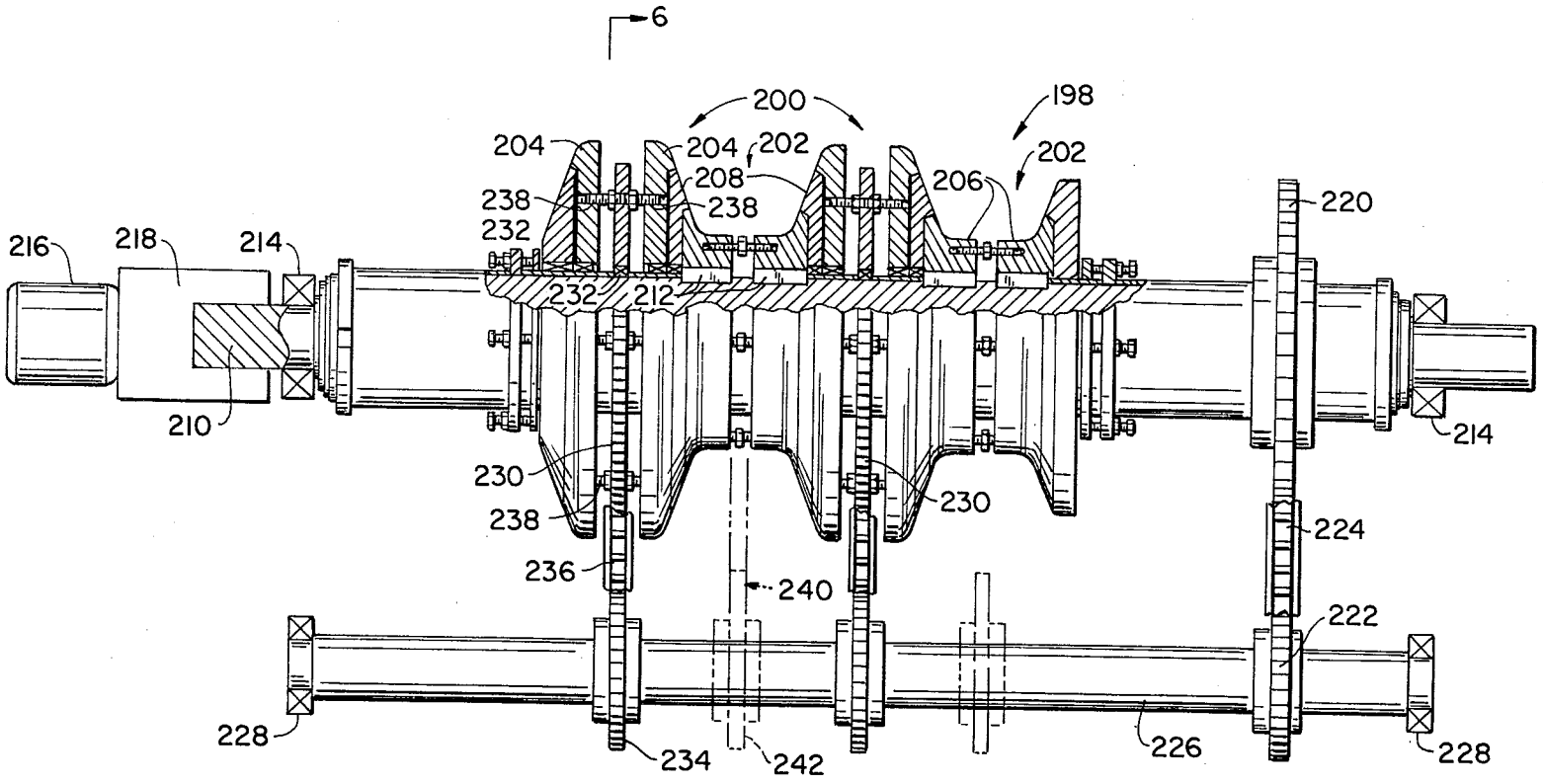
FIG. 5 is a view similar to FIG. 4 but illustrates another manner in which the roll dies are driven and mounted.
Figure 6:
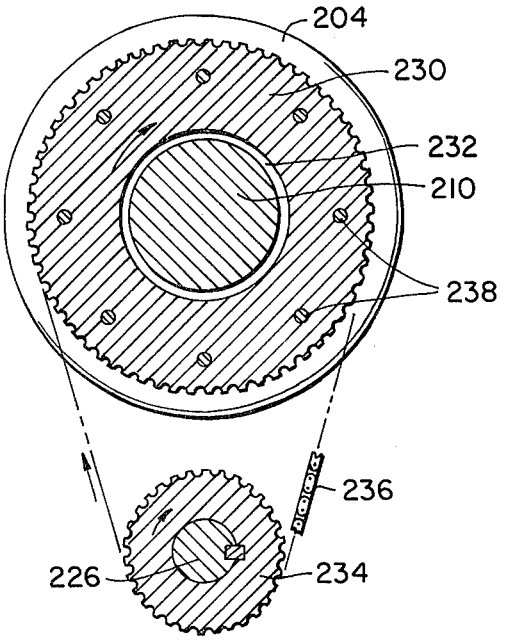
FIG. 6 is a side elevational view, in section, and is taken on line 6—6 of FIG. 5.

Referring now to FIGS. 5 and 6, as was discussed earlier, with an increasing corrugation depth the differential peripheral speed between the maximum and minimum diameters of a fixed corrugating die become increasingly large and, unless corrected, will make it virtually impossible to satisfactorily corrugate plate. Similarly, with an increasing corrugation depth and especially also with an increasing plate thickness the forces that must be exerted by the corrugating dies to properly deform the plate become increasingly large. Thus, to merely drive the large diameter, male dies (90 in FIG. 4) will often be insufficient since the dies would slip, gall and soon become unusable. It is, therefore, often necessary to drive the smaller diameter female die (92 in FIG. 4) also so as to be able to exert the necessary forces without causing slippage. The arrangement shown in FIG. 5 illustrates the manner in which the various corrugating dies are power driven in accordance with one embodiment of the invention.

A corrugating roll 198 (which can be an upper or a lower corrugating roll) has two male dies 200 and two female dies 202, each of which is defined by a pair of male and female die halves 204, 206, respectively. Further, the corrugating roll illustrated in FIG. 5 is provided with intermediate or slanted dies 208 which correspond to the slanted corrugation sides 84 (see FIG. 3).

In the illustrated embodiment the female die halves 206 are connected to shaft 210 with keys 212 so that the female die halves rotate with the shaft. The shaft itself is rotatably mounted in journal bearings 214 carried in a frame (not shown in FIGS. 5 and 6). Shaft 210 is power driven, either by an arrangement such as is illustrated in FIGS. 1 and 2 or with an individual electric motor 216 that drives the shaft via a reduction gear 218.

A drive chain sprocket 220 is keyed and rotates with the main roll shaft 210 and drives another chain sprocket 222 via a drive chain 224. Sprocket 222 is keyed to a drive shaft 226 which is spaced from and parallel to main shaft 210 and which is rotatably mounted to the frame of the corrugator (not shown in FIGS. 5 and 6) with journal bearings 228.

Disposed between opposing faces of each set of male die halves 204 is a relatively large diameter chain sprocket 230 which is rotatably mounted to shaft 210 with a roller bearing 232. A relatively small diameter chain sprocket 234 is aligned with the large sprocket 230 and is keyed to drive shaft 226 so that it rotates therewith. A drive chain 236 connects the two sprockets.

Further, the large diameter sprocket is locked to the associated male die halves as with circumferentially spaced apart, axially extending threaded bolts 238. Preferably, each threaded bolt includes left and right hand threaded portions which engage the sprocket and the corresponding male die halves so as to enable an adjustment of the axial spacing between the die halves in the above-discussed manner.

With an appropriate choice of gear ratios between sprockets 220, 222 and 230, 234 the male die halves can thus be rotated at a rate so that the peripheral speed of their maximum diameter corresponds to the peripheral speed of the smallest diameter of the female die halves 206 (which are keyed to shaft 210) and, therefore, to the linear speed of the plate being corrugated. At the same time, both the female and the male die halves are power rotated whereby much greater forces can be transmitted to the plate being corrugated and plate of greater thickness and/or having deeper corrugations can be readily formed without having to increase the number of stands or causing slippage between the corrugating rolls and the plate.

The power drive for the corrugating roll 198 illustrated in FIGS. 5 and 6 is readily adapted for a variety of operating conditions which may place varying demands on the drive. In the illustrated embodiment, the slanted dies 208 are freewheeling, that is that they are rotatably mounted to shaft 210 with roller bearings as is illustrated in FIG 5. Should more power be required the slanted dies may also be power driven by keying them to the shaft while mounting the female dies 206 to the shaft with bearing (not shown) so that they are rotatable relative to the shaft. In such an event, an additional chain drive 240 (illustrated in phantom lines in FIG. 5) is provided which comprises a sprocket 242 keyed to drive shaft 226 and which drives a relatively large diameter sprocket (not shown in FIG. 5) disposed between opposing female die halves (in the manner in which sprocket 230 is disposed between the male die halves) at the desired rate while the main shaft 210 is rotated at a rate so that the peripheral speed of a portion of the slanted die 208, say its center diameter, corresponds to the linear speed with which the plate being corrugated travels past the corrugating roll.

Since the power transmitted to the plate being corrugated by the drive illustrated in FIGS. 5 and 6 is large, it may sometimes be possible to dispense with power driving the opposite corrugating roll, that is to say under certain conditions it will be possible to drive only the upper or the lower corrugating roll of each stand. Further, it may also be possible to utilize a given drive shaft 226 to drive the die halves of two adjoining, i.e. of an upstream and a downstream corrugating roll by placing the drive shaft intermediate between the two rolls and appropriately arranging the chain drives on the drive shaft.

Figure 19:
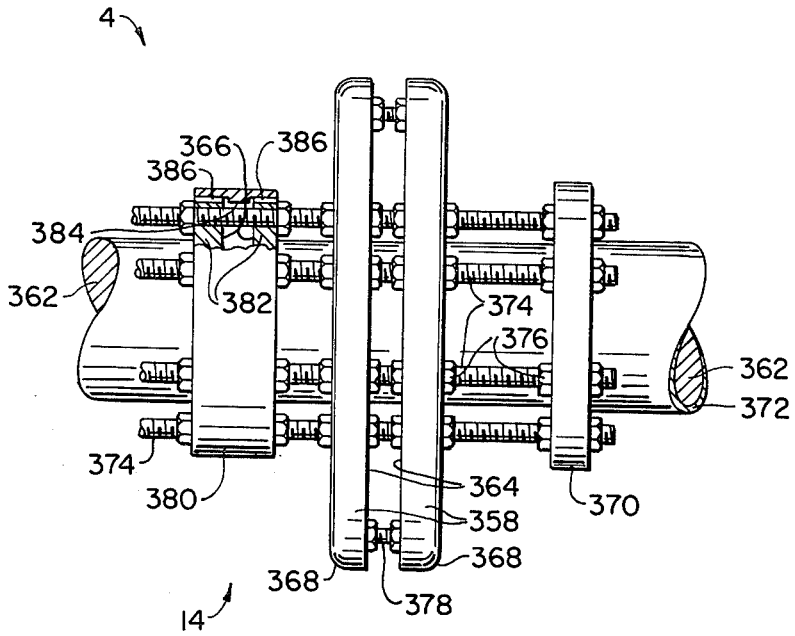
FIG. 19 is a fragmentary front elevational view, in section, and is taken on line 19—19 of FIG. 1.

Referring now especially to FIGS. 1 and 19, the downstreammost corrugating stand 4 may be provided with corrugating dies or discs shaped somewhat differently than those utilized at stands 6 and 8. The corrugating dies of stand 4 are particularly adapted for use in instances in which there is little or no deformation of the corrugated plate as when the downstreammost stand is provided primarily to assure dimensional stability of the finish corrugated plate. Each corrugating roller 12 and 14 is defined by sets of alternating male corrugating disc halves 358 and female corrugating disc halves 382 mounted to a main shaft 362 which is journaled to the frame 16 in the above discussed manner. Both the male and the female discs have flat sides 364, 366, respectively, so that during corrugating the slanted corrugation sides are unsupported. However, the discs include radiused areas 368 which correspond to the curved transition 88 of the corrugated plate (see FIG. 13). As a result, during corrugating the peaks and troughs of the corrugated plate are effectively "stretched" between the male and female disc halves of the corrugating stand 4.

To mount discs 358, 360, an end collar 370 is provided which circumscribes shaft 362. A pipe sleeve 372 abuts against the end collar and the earlier discussed adjustment nut 128 threaded onto the shaft. The male and female disc halves 358, 360 are keyed to shaft 362 and they are locked together with circumferentially spaced apart, elongated rods 374 which are threaded over their entire length. Each male and female disc halves has aligned apertures through which the threaded rods extend. The rods include a nut 376 on each side of each of the discs and end collars for locking the discs and the roller together at their desired relative positions.

As an alternative to the disc arrangement shown at stand 4 in FIG. 1 and to reduce excessive differential speeds, FIG. 19 illustrates a sleeve 380 instead of female discs 360. The sleeve is rotatably mounted on circular flanges 382 which, in turn, are engaged by rods 374. A radial lip 384 secures the sleeve against relative axial movements and bearings 386 enable the sleeve to rotate relative to the flanges.

To rigidify the relatively large diameter, male disc halves 358, adjustable spacer bolts 378 (which operate in the manner in which spacer bolts 100 shown in FIG. 4 operate) can be provided.

Figure 7:
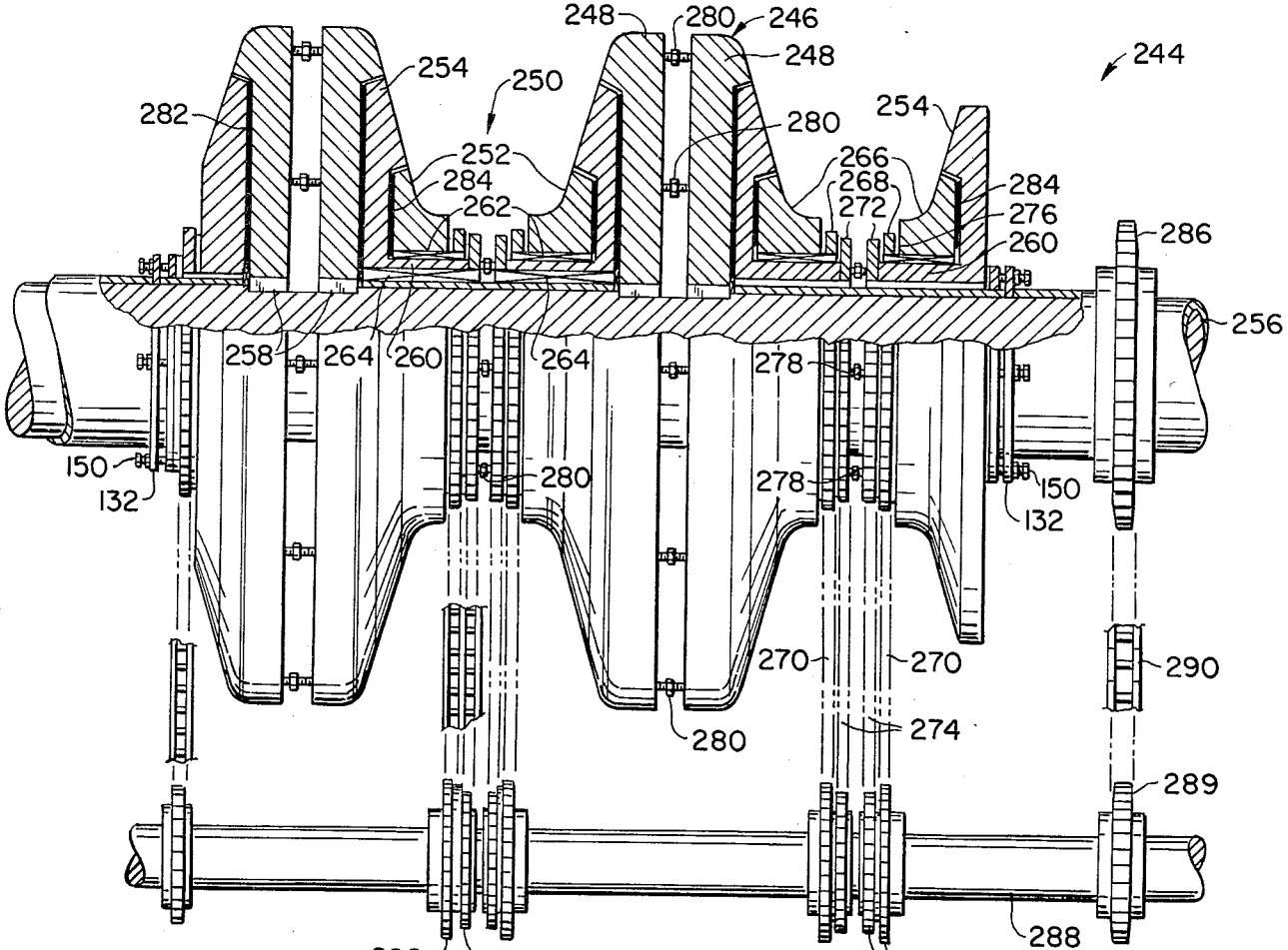
FIG. 7 is a front elevational view similar to FIG. 5 and illustrates a refinement in the power drive for the roll dies.

FIG. 7 illustrates another embodiment of the present invention for power rotating corrugating dies at differing rates. A (upper or lower) corrugating roll 244 is defined by a plurality, say two male corrugating discs or dies 246 each of which is defined by a pair of opposing male disc halves 248, two female discs or dies 250 each of which is defined by two female disc halves 252 and intermediate, slanted discs or dies 254 all of which are carried by a main roll shaft 256 that is journaled in the frame (not shown) of the corrugator and power driven in the manner described above. Keys 258 secure the male disc halves to the shaft for rotation therewith while the female disc halves 252 and the slanted discs 254 are rotatable relative to the shaft.

Each slanted disc includes a hub 260 which extends towards the adjacent female disc half 252 and which has a sufficient length so that the female disc halves can be rotatably mounted thereto with needle bearings 262 or the like. An additional set of needle bearings 264 rotatably mount each hub 260 to the main roll shaft 256.

It should be noted that during corrugating, a plate is effectively stretched over the male discs 246 by forces applied to the plate by the cooperating female discs in their radiused areas 266. As a result, it is not necessary to continuously contact the plate with the female discs; in fact, the portion of the female discs intermediate the radiused areas can remain open as is illustrated. In accordance with the present invention this has been done so as to provide space for power rotating both the female disc halves 252 and the slanted discs 254.

Each female disc half 252 is fitted with a sprocket 268 that is spaced from the disc so as to enable it to mesh with the roller chain 270. The sprocket is bolted to the disc with bolts (not shown) engaging threaded apertures in the face of the disc.

Similarly, a sprocket 272 is bolted to the end face of each slanted die hub 260 and cooperates with a corresponding roller chain 274. Further, ring bearings 276 keep sprockets 268, 272 spaced apart and permit relative rotational movements between them.

Left and right hand threaded adjustment bolts 278 maintain and permit the adjustment of the spacing between opposing sprockets 272 and thereby between female die halves 252 and slanted discs 254. Similar adjustment bolts 280 permit the adjustment of the spacing between male disc halves 248 so as to render all discs adjustable in an axial direction in the manner discussed above.

Thrust bearings 282, 284 are further provided between contacting faces of the male disc halves 248, the slanted discs 254 and the female disc halves 252 so as to permit relatively low friction rotational movements between them in the manner discussed in greater detail above.

Further, a drive sprocket 286 is keyed to main shaft 256 and rotates a parallel drive shaft 288 via a roller chain 290 and a sprocket 289. Rotation of drive shaft 288 is in turn imparted to the female disc halves 252 and the slanted discs 254 by sprockets 292, 294 which are keyed to the drive shaft and which engage roller chains 270 and 274, respectively. By properly selecting the gear ratios between the sprocket wheels the desired rate of rotation can be imparted to the rolling discs.

It will be noted that each corrugating disc of roll 244 is power rotated. Further, the power drive for the individual discs is conveniently located between opposing faces of the female disc halves 252, while the axial adjustability of the disc halves is maintained.

The corrugated roll construction illustrated in FIG. 7 and the power drive therefore are particularly adapted for heavy duty use for forming deep corrugations and for corrugating plate having a thickness in the order of ¼" or more.

Figure 8:
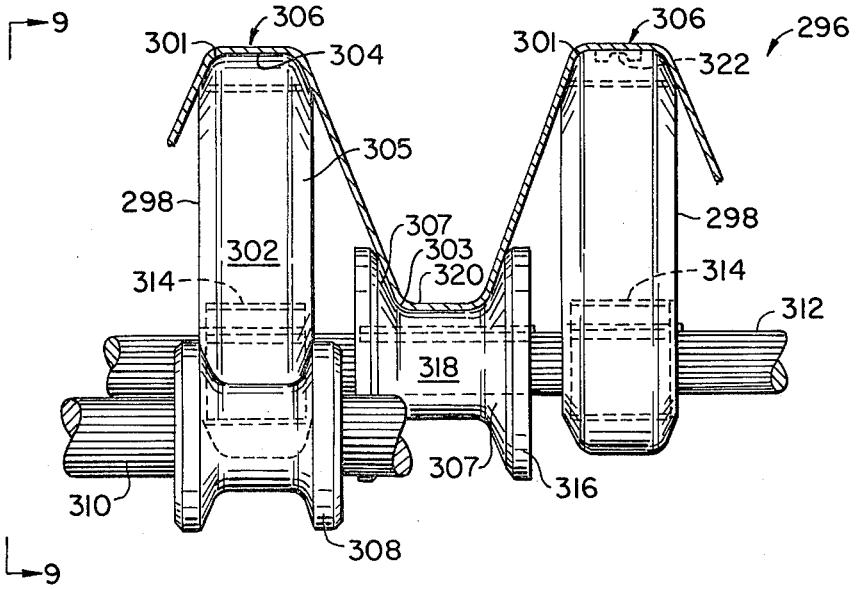
FIG. 8 is a fragmentary, side elevational view, partially in section, and illustrates another embodiment of the present invention for rotating roll dies at differing rates.
Figure 9:
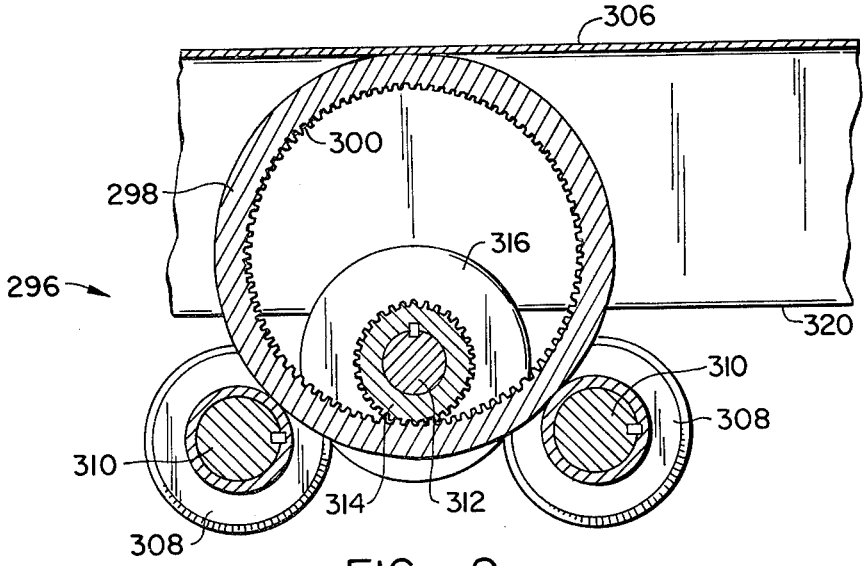
FIG. 9 is a side elevational view, in section, and is taken on line 9—9 of FIG. 8.

Referring to FIGS. 8 and 9, another aspect of the present invention contemplates to construct a corrugating roll 296 in a manner somewhat different from that described above. Generally speaking, corrugating roll 296 is especially adapted for corrugating relatively deep corrugations (e.g. having a depth in excess of 6"). The corrugating roll is defined by spaced apart, annular crown or male die rings 298 which include an internal gear 300 and which have an outer periphery 302 which corresponds to the desired shape of the concave side 304 of corrugation peaks 306. A pair of die support rollers 308 is carried on spaced apart support shafts 310. The peripheries of the support rollers have a profile which coincides with the profile of the male die rings so as to guide the rotational movement of the die ring and support it when a plate is being corrugated. It is presently preferred that the support shafts 310 are stationary and the support rollers are rotatably mounted thereto.

A drive shaft 312 oriented parallel to support shafts 310 extends through the interior opening defined by the male die ring 298 and mounts a drive gear 314 which is keyed to the shaft and which meshes with the internal ring gear 300 so that upon rotation of the drive shaft the die ring is rotated at a rate which is a function of the gear ratio between the drive gear and the internal ring gear.

Mounted between the male ring dies 298 are relatively small diameter female corrugating dies 316 which have a concave outer periphery 318 shaped to correspond to the convex configuration of corrugation valleys 320. The female dies are keyed to drive shaft 312 so that they rotate with the shaft. By appropriately selecting the gear ratio between drive gear 314 and internal ring gear 300 the peripheral speed of the male die ring and the female corrugating roll 298, 316, respectively, can be selected to be equal at a selected diameter of each, e.g. at their respective maximum and minimum diameters.

It will be observed that a portion of slanted corrugation sides 84 between radiused portions 301 and 303 of male dies 298 and female dies 316, respectively, is unsupported. Since the slanted corrugation sides are straight and the respective dies merely stretch the sides between the radiused portions, direct support throughout the width of the slanted corrugation sides is normally not necessary. If desired, however, the length of support for the corrugation sides can be increased by extending slanted sides 305, 307 of the male and female dies 298, 316, respectively, further towards each other.

Corrugating roll 296 has a number of advantages over the earlier discussed corrugating rolls. First, drive shaft 312 can be given a much smaller diameter since support shafts 310 greatly reduce the forces which are applied against the drive shaft. Further, for corrugating large, e.g. deep corrugations, the dies, and particularly the relatively larger diameter male die rings can be given a much smaller diameter than was heretofore possible because the corrugation valleys 320 can extend past the center line of the male die rings since the support shaft for the die rings is disposed below (or above, for the upper corrugating roll, not shown in FIGS. 8 and 9) the center line for the die. Since the corrugation valleys must at all times clear the support shafts, male dies concentrically carried on and wholly supported by main roll shafts (as shown in FIG. 7, for example) require relatively large diameters so that the corrugations clear the shaft and leave enough space for the female dies.

Further, corrugation roll 296 makes it easy to replace dies for corrugating a different profile and/or for exchanging a worn die, for example. To do so, one simply needs to raise drive shaft 312 (by loosening the bearings which journal it to the frame, not shown in FIGS. 8 and 9) and thereafter slipping the male dies rings 298 off the shafts by engaging it with a sling carried by an overhead crane or the like.

Under certain circumstances, for example, for corrugating heavy walled plate, supports shafts 310 can be utilized as drive shafts by power rotating them and by fitting the flat crown surface with an exterior gear 322 (shown in phantom lines in FIG. 8 only) which are recessed below the crown surface and which mesh with corresponding gears (not shown in FIG. 8) which protrude from die support rollers 308. In that event the die support rollers are keyed to the support shaft 310 and the latter are power rotated.

Figure 10:
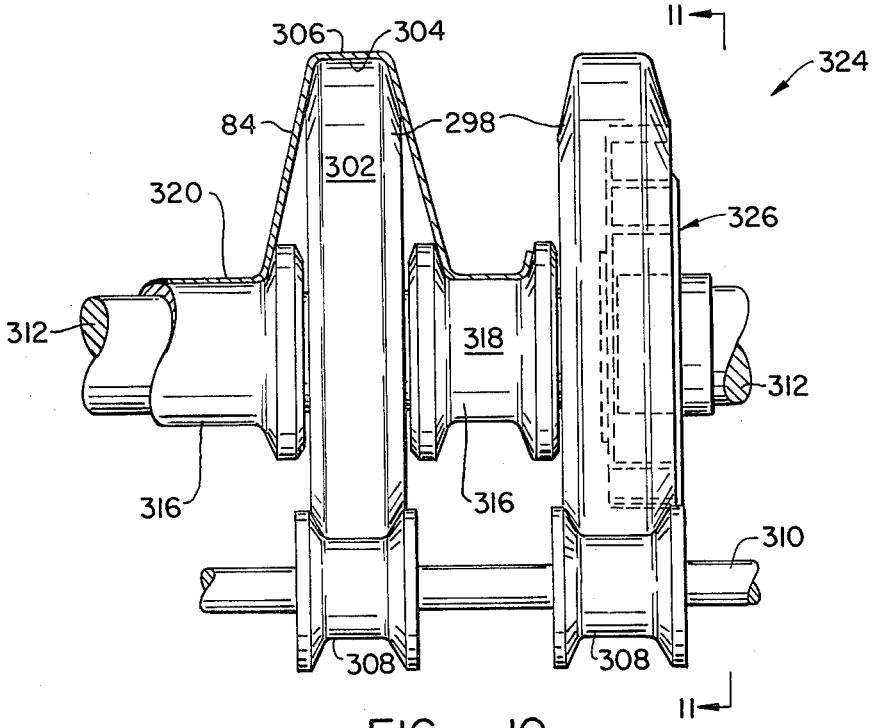
FIG. 10 is a front elevational view similar to FIG. 8 and illustrates another embodiment of the present invention.
Figure 11:
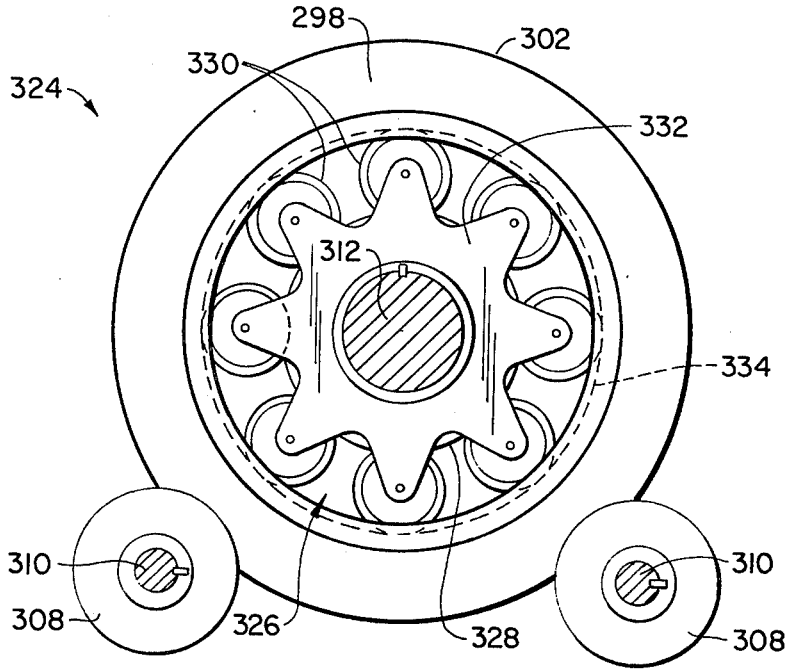
FIG. 11 is a side elevational view similar to FIG. 9 and is taken on line 11—11 of FIG. 10.
Figure 12:
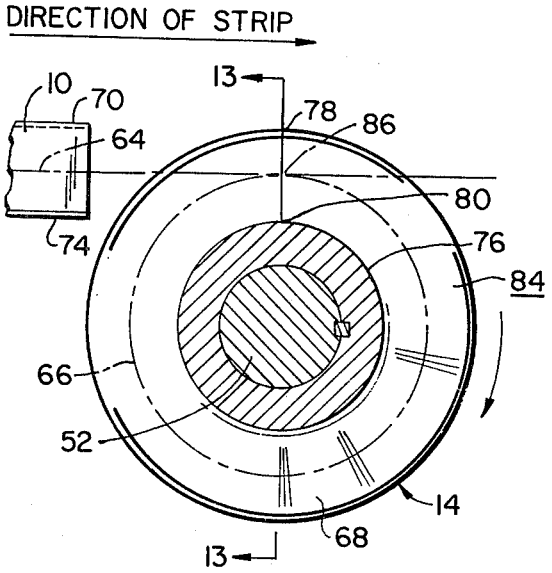
FIG. 12 is a schematic, side elevational view of a die for forming deep corrugations and illustrates the differential speeds between the plate being corrugated and different portions of the periphery of the die.

FIGS. 10 and 11 illustrate a corrugating roll 324 which is constructed similar to corrugating roll 296 shown in FIGS. 8 and 9 but which utilizes a somewhat different drive. Instead of a pinion-ring gear drive it employs a planetary gear drive 326 which comprises a sun gear 328 keyed to and driven by main drive shaft 312, a plurality of planetary gears 330 rotatably mounted to a spider 332 and an internal ring gear 334 carried on the inside of male die ring 298 and in engagement with the planetary gears as is shown in FIG. 11. Upon rotation of drive shaft 312 ring disc 298 is rotated in a conventional manner at a rate which is determined by the gear ratios between the sun gear 328, the ring gear 324 and the planetary gears 330. In all other respects, the construction and operation of corrugating roller 334 illustrated in FIGS. 10 and 11 is the same as that of corrugating roller 296 shown in FIGS. 8 and 9. The spider 332 is conventionally secured against rotation, for example by fixing it to a stationary member of the frame (not shown in FIGS. 10 and 11.

Figure 14:
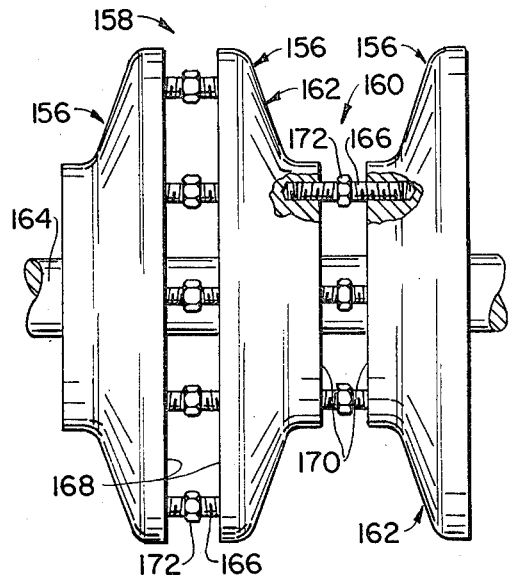
FIGS. 14 and 15 are schematic representations of alternative manners of interconnecting adjoining corrugating die halves.
Figure 15:
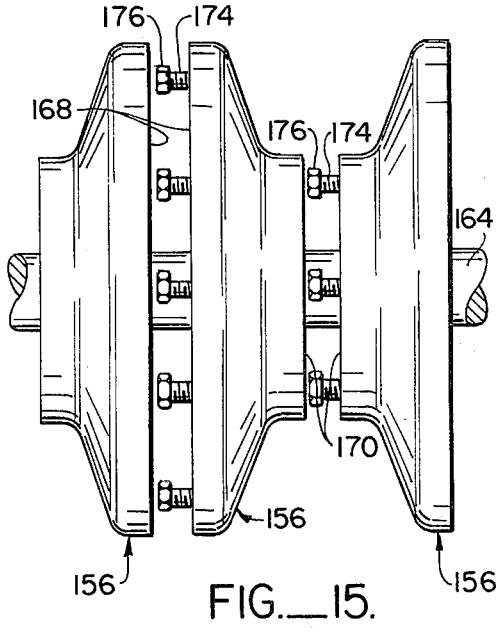

Referring now to FIGS. 14 and 15 in certain instances, especially when forming relatively shallow corrugated plate, it may not be necessary to rotate the male and female dies at differing rates because of a small difference between their peripheral speeds. In such instances, the adjustability of the dies can be maintained in accordance with the present invention by providing die discs 156, each of which defines approximately half a male die 158, half a female die 160 and the entire die section 162 which corresponds to the slanted corrugation sides 84 (shown in FIG. 3, not shown in FIGS. 14 and 15). The die discs are conventionally mounted to a shaft 164, e.g. they are keyed thereto. Left and right hand threaded bolts 166 (FIG. 14) are threaded into opposing, correspondingly threaded apertures in the opposing faces 168, 170 of the die discs. The threaded bolts preferably include a fixed nut 172 so that upon turning the nuts in one direction or the other, the die discs are spread apart or drawn towards each other to thereby adjust the lateral positions of the dies.

FIG. 15 illustrates an alternative construction in which the die discs 156 are spaced apart by bolts 174 threaded into one of each pair of opposing disc faces 168, 170. The discs are drawn together (for example with bolts 150 and adjustment nuts 128 as illustrated in FIG. 4) until the heads 176 of the bolts engage the opposing disc face 168 or 170. By turning the bolts the spacing between the discs can be adjusted as described above.

Figure 16:
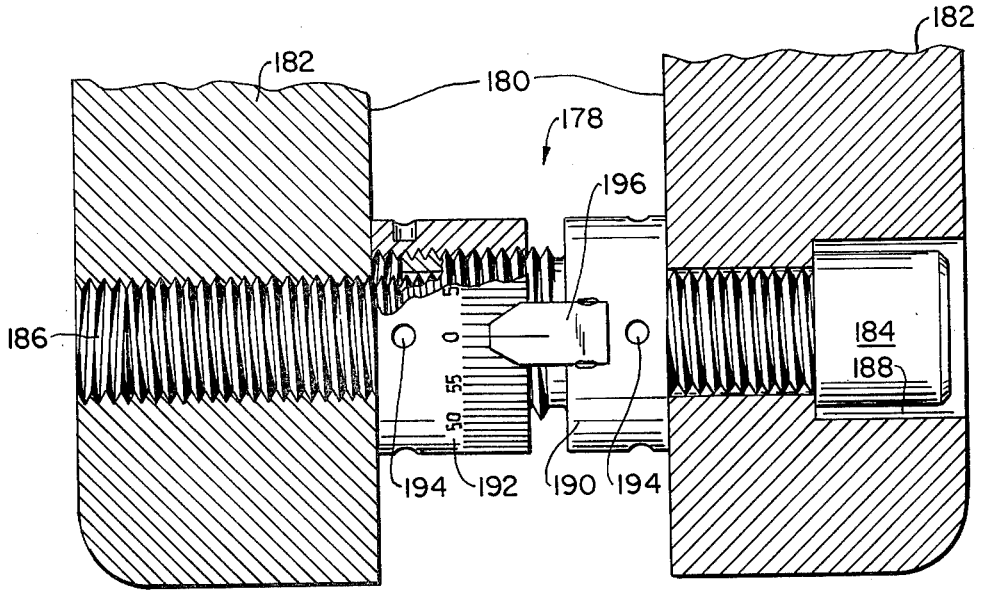
FIG. 16 is a fragmentary illustration of an adjustable die half interconnection including a built-in distance measuring device.

Turning now briefly to FIG. 16, in yet another embodiment of the invention, a measuring device 178 may be provided to give a visual indication of the spacing between the opposing faces 180 of a pair of male or female die halves 182 suitably mounted to a shaft (not shown in FIG. 16). The die halves are interconnected by a threaded bolt, say an Allenhead bolt 184 which engages a threaded aperture 186 in one of the die halves and a counterbore 188 in the other die half so that the die halves can be drawn together by turning the bolt in one direction and spread apart by turning the bolt in the opposite direction. Disposed between the die halves and about bolt 184 is the measuring device which comprises a tubular spacer defined by a tubular spacer bolt 190 which circumscribes bolt 184 and which threadably engages a threaded, tubular barrel 192. Both the spacer bolt and the barrel may include spanner holes 194 or they may have a square or hexagonal configuration so that they can be engaged with a conventional wrench. Further, the spacer bolt includes a pointer 196 and the barrel is provided with calibration marks set so as to indicate a zero setting, for example, and the distance from the zero setting if the spacer bolt and the barrel are rotated relative to each other in a clockwise or a counterwise direction.

Measuring device 178 greatly facilitates the adjustment of the relative distance between opposing die halves. To change the spacing, Allenhead bolt 184 is loosened, the barrel is rotated relative to the spacer bolt so as to yield the desired spacing between the die faces 180 and the Allenhead screw is thereafter retightened until the die halves are firmly biased against the measuring device. It is apparent that the measuring device eliminates the need for taking individual measurements; instead all that is necessary is to loosen the bolts, set the measuring device to the desired spacing, and thereafter retighten all bolts. Significant time savings for changing the spacing between the die halves are thereby attained.

Figure 20:
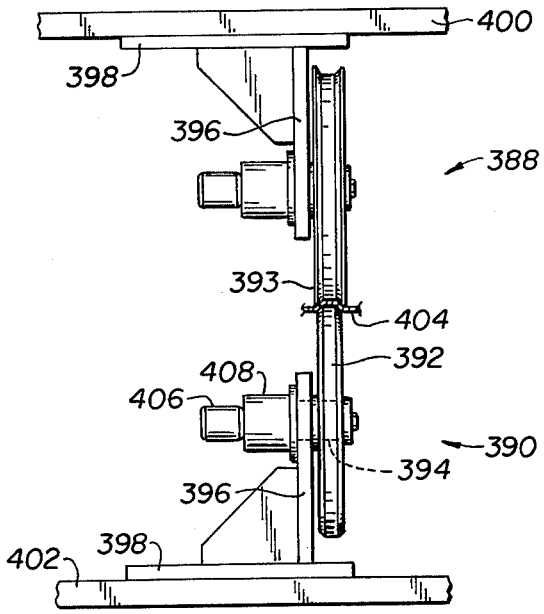
FIG. 20 is a schematic, fragmentary and elevational view of another embodiment of the present invention in which the corrugating rolls are defined by upper and lower sets of individually mounted corrugating discs.
Figure 21:
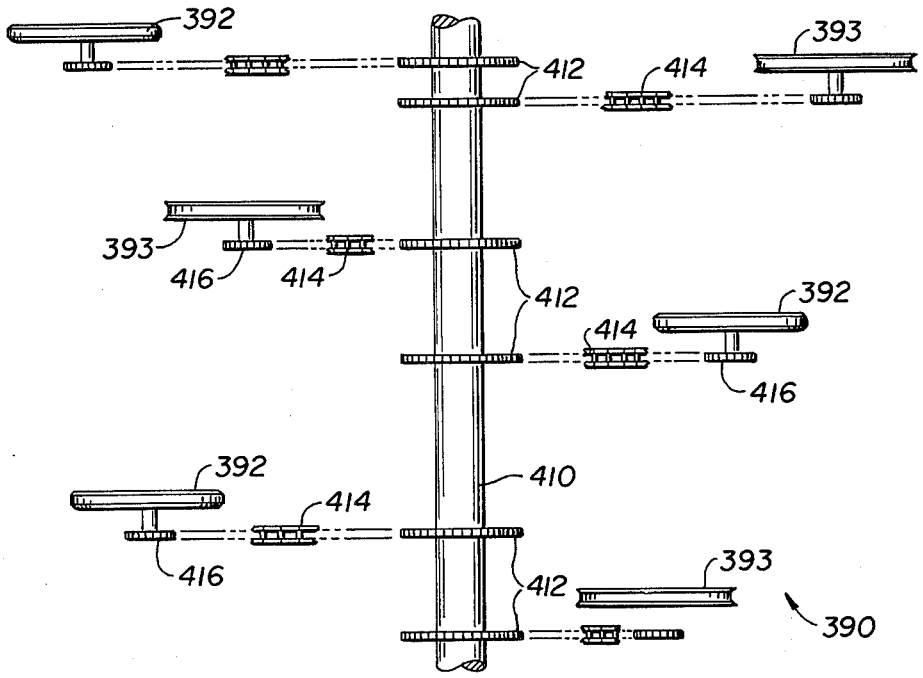
FIG. 21 is a schematic plan view of the lower set of corrugating rolls shown in FIG. 20 and of an alternative manner for driving such discs.

Referring to FIGS. 20 and 21, in accordance with another embodiment of the invention, the upper and lower corrugating rolls 12 and 14 illustrated in FIG. 2, for example, are defined by upper and lower sets of individual corrugating discs 388, 390. As described above, the large diameter or male discs 392 have a convex profile, while the cooperating, relatively small diameter female discs 393 have a concave profile as is schematically shown in FIG. 20. Each disc is mounted to an individual shaft 394 which, in turn, is rotatably mounted to a vertically oriented bearing support 396 affixed to a base 398. The base plates are mounted, e.g. bolted, clamped or the like to upper and lower, generally horizontally disposed support frames 400, 402 which are vertically spaced apart so that the peripheries of the discs just contact a plate 404 being corrugated. Preferably the base plates are secured to the frame so that their relative positions can be changed. In this manner the positioning of the discs can be adjusted for rolling difficult profiles, for example. In one embodiment, an electric motor 406 is provided for each driven disc and coupled to the corresponding shaft 394 via a gear box 408.

The discs of each upper and lower disc set 388, 390 need not be axially aligned since each is independently mounted to a shaft 394. Instead, the disc axes may be offset with respect to each other as is shown in FIG. 21 although they must be parallel to each other. With the appropriate gearing or with appropriate electrical controls for motors 406, their speeds can be regulated so that each disc rotates at a rate at which its peripheral speed equals or at least approximates the linear speed of plate 404, preferably at or in the vicinity of the disc diameter at which maximum forces are generated between the plate and the disc.

FIG. 21 shows an alternative drive to the motor 406 and gear box 408 shown in FIG. 20. In their stead a main drive shaft 410 is provided for each disc set 388, 390 which rotates some or all of the discs of each set at the desired rate via sprockets 412 keyed to the shaft, drive chains 414 and sprockets 416 keyed to disc shafts, 394. By selecting the appropriate gear ratios, the desired rates of rotation for the discs are attained in the manner more fully discussed above.

The embodiment of the invention illustrated in FIGS. 20 and 21 has the advantage that it eliminates the need for a single shaft for each corrugating roll which must be at least as long as the width of the sheet being corrugated. Thus, bending moments generated in shafts 394 are much less so that the shaft can have a much smaller diameter. Further, the much smaller shaft size enables the use of discs haing smaller diameters and greatly facilitates the handling, replacement or changing of discs.

Figure 17:
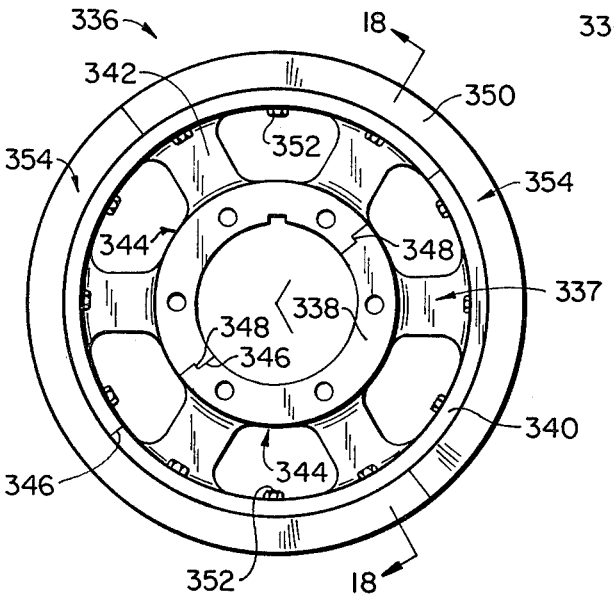
FIG. 17 is a side elevation of a disc shaped corrugating die constructed in accordance with the present invention.
Figure 18:
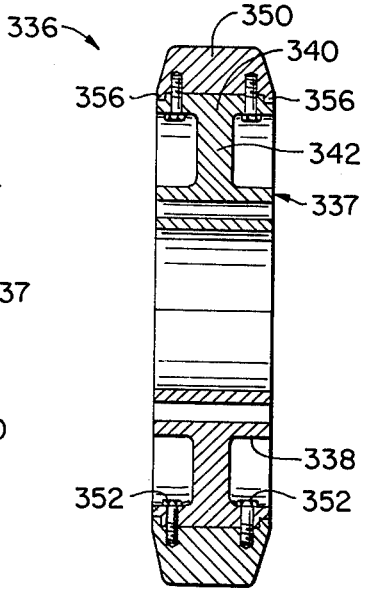
FIG. 18 is a front elevation, in section, and is taken on line 18—18 of FIG. 17.

Referring to FIGS. 17 and 18, the individual disc shaped corrugating dies discussed above and shown in FIG. 7 or 20, for example, at times can have relatively large diameters, rendering them heavy to handle and fabricate and, if made of one piece, relatively expensive. To reduce the weight of such dies and render them more readily handled, the present invention contemplates to construct certain large diameter disc dies 336 in the form of a wheel 337 defined by a hub 338 that can be placed over the main roll shaft (not shown in FIGS. 17 and 18) of the corrugator, an outer rim 340 and spokes 342 which interconnect the former with the latter. The wheel may be of a one-piece construction or it may be constructed of two wheel halves 344 which have a parting line 346 including mutually opposing centering ledges 348 and which are suitably secured, e.g. bolted together. The two-piece construction of the wheel has the advantage that it can be demounted from the roll shaft by merely separating the wheel halves 344 and withdrawing them from the shaft in a radial direction without having to disengage the main roll shaft from its journal bearing and the frame of the corrugator. Thus, significant timesavings for changing dies are attained.

Disposed about rim 340 is a corrugating rim 350 which has the desired, e.g. trapezoidal cross-section and which is secured to the rim with multiple, radially oriented bolts 352. The corrugating ring is constructed of an appropriate material such as alloy steel so that it can withstand the forces applied to it during corrugating without suffering excessive wear. Although the corrugating ring can be a one-piece ring, in the preferred embodiment, the ring is made up of two opposing ring halves 354 to facilitate the removal of the halves from the wheel 337. Further when constructed of two halves, an axially oriented ledge 356 can be formed adjacent axial ends of the rim and the corrugating ring which constrain the two to each other and which relieve bolts 352 of large axially acting forces which are sometimes generated during corrugating.

I claim:

1. In an apparatus for roll forming a flat sheet into a corrugated sheet having an undulating profile defined by alternating corrugation peaks and corrugation troughs each forming a generally concave surface and a parallel, generally convex surface, the peaks and trough being interconnected by slanting corrugation sides, the apparatus including at least an upper forming roll disposed on one side of the sheet and a cooperating lower forming roll disposed on another side of the sheet, the improvement to the rolls of said one pair of rolls comprising for each roll: a first, generally disc shaped die having, in profile a generally convexly shaped periphery and a relatively large maximum diameter, means for rotatably mounting the first die; a second, generally disc shaped die having, in profile, a generally concave periphery and a relatively smaller maximum diameter; means for rotatably mounting the second die in an axially spaced relation from the first die so that the peripheries of the dies, in profile, corresponds to the desired shape of the convex and concave surfaces of the corrugated sheet and so that the dies rotate about parallel axes; a third disc shaped die mounted to the shaft and disposed between the first and second dies, the third die having a surface for contacting a corresponding corrugation side which is shaped complementary to the shape of the side; means for power-rotating at least one of the disc shaped dies; and means permitting the first, second and third dies to rotate at differing rates of rotation.

2. Apparatus according to claim 1 wherein the means for power-rotating the dies includes means for power-rotating the shaft; and means keying the first die to the shaft for rotation of the former with and at a rate equal to that of the latter.

3. Apparatus according to claim 2 wherein the means permitting the second and third dies to rotate at rates different from those of the first die comprises bearing means rotatably mounting the second and third dies to the shaft.

4. Apparatus according to claim 1 wherein the first and second dies each are defined by a pair of opposing, disc shaped, axially spaced die halves mounted to the shaft, and including means for adjustably interconnecting the die halves of each of the dies.

5. Apparatus according to claim 4 wherein the interconnecting means includes means for selectively varying the axial distance between the die halves for each of the first and second dies.

6. Apparatus according to claim 1 wherein the first die is defined by a die wheel including a hub engaging the means for rotatably mounting the first die and a rim radially spaced from the hub, a corrugating ring constructed of a material different from the material of which the wheel is constructed, and means for demountably securing the corrugating ring to the rim.

7. Apparatus according to claim 6 wherein the corrugating ring is defined by at least two ring segments.

8. Apparatus for corrugating sheet metal comprising: a frame, a plurality of serially arranged corrugating stands mounted to the frame, each stand being defined by a pair of cooperating corrugating rolls; the rolls of at least one stand comprising a pair of spaced apart, parallel first and second shafts, and a plurality of generally disc shaped roll dies carried on each shaft, the roll dies being axially arranged over a portion of the length of each shaft and alternatingly defining a relatively large diameter convex roll die, a relatively smaller diameter concave roll die and an intermediate roll die disposed on the shafts intermediate adjacent convex and concave roll dies, the intermediate die having a corrugated sheet engaging surface which generally slopes relative to an axis of the shaft and which has a radial extent intermediate that of the convex and the concave dies; means for power rotating at least some of the dies on at least one of the shafts of the one stand; whereby the sheet metal is grasped by opposing roll dies of the one stand and the power-rotated roll dies frictionally engage the sheet and advance it in a downstream direction while causing a deformation of the profile of the sheet as it passes between the rolls; and means for rotating at least some of the roll dies on the shafts of the one stand at differing rates which take into account differences in the diameters of the dies so that a peripherial speed of the convex die at a first diameter, a peripheral speed of the concave die at a second, different diameter, and a peripheral speed of the intermediate die at a third diameter which differs from the first and second diameters are substantially equal to the speed with which the sheet passes the one stand.

9. Apparatus according to claim 8 wherein the dies are axially movably mounted on the shaft, and including means carried on the shaft for biasing the dies in an axial direction towards each other.

10. Apparatus according to claim 9 including bearing means disposed between opposing surfaces of the dies to facilitate the rotation of the convex and concave dies at differing rates.

11. Apparatus according to claim 10 wherein the convex and the concave dies are made of opposing die halves carried on the shafts, and means carried by and threadably engaging the die halves for varying the spacing between them and therewith the effective width of the respective dies.

12. Apparatus according to claim 8 wherein the convex and concave roll dies are defined by discs carried on the shafts, die rings demountably applied over a periphery of the discs; and means securing the rings to the discs.

13. Apparatus according to claim 12 wherein the rings are made of alloy steel.

14. Apparatus according to claim 12 wherein the rings are defined by spaced apart, annularly shaped ring halves; wherein a center portion of the periphery of the disc includes a radially protruding lip; wherein the rings include grooves formed and arranged to engage the lips; and including means biasing the ring halves of each die towards each other and into engagement with the lips; whereby the interengagement of the grooves and the lips opposes forces acting on the rings in a generally axial direction during the corrugation of the sheet.

15. In an apparatus for corrugating sheet metal, the apparatus having a frame, a plurality of serially arranged corrugating stands each defined by opposing and cooperating first and second corrugating rolls and means rotatably mounting the rolls to the frame, and power means for driving the rolls at predetermined speeds so that a flat sheet inserted between the first and second rolls of the first stand is grasped by the rolls and transported in a downstream direction towards the last stand of rolls while the flat sheet becomes longitudinally corrugated and issues from the last stand as a finish corrugated sheet, the improvement to the frame comprising: a base, a bearing block for each roll having a generally rectangular outline; means rigidly connected with the base and defining a mounting flange; bolt means for the bearing blocks of each stand rigidly biasing the bearing blocks against each other and against the mounting flange so that the mounting flange and the bearing blocks form a rigid and immovable member; and means establishing metal-to-metal contact areas over substantially the full extent of the members between adjoining bearing blocks for the first and second rollers, respectively, of all stands; whereby upon the tightening of the bolt means the bearing blocks define a continuous, rigid beam which mounts all rolls and which, upon the loosening of the bolt means, permits the ready removal of any one or all of the rolls.

16. Apparatus according to claim 15 including means vertically spacing the mounting flange from the base, wherein the bearing blocks for the first rollers are disposed on one side of the mounting flange, and wherein the bearing blocks for the second rollers are disposed on the other side of the mounting flange, and wherein the bolts means further rigidly secure the respective bearing blocks to the opposite sides of the mounting flange.

17. Apparatus according to claim 16 including stanchions vertically protruding from the base, and means for securing the mounting flange to portions of the stanchion spaced from the base.

18. Apparatus according to claim 17 wherein the metal-to-metal contact establishing means for at least some of the bearing blocks are defined by respective surfaces of the bearing blocks facing bearing blocks of adjoining stands.

19. Apparatus according to claim 18 wherein the bearing block surfaces have a generally rectangular configuration and wherein the surfaces of bearing blocks disposed between the base and the mounting flange are in metal-to-metal contact with corresponding surfaces of the stanchions.

20. Apparatus according to claim 19 wherein the mounting flange is defined by spaced apart flanges of an I-beam, the I-beam including a web interconnecting the flanges, wherein portions of the bearing blocks in contact with the mounting flange have a generally rectangular outline, and wherein the rectangularly outlined portions of the bearing blocks are in metal-to-metal contact with the respective flanges of the I-beam.

21. Apparatus according to claim 19 wherein the bearing blocks are defined by substantially homogeneous metal blocks perpendicular cross-sections of which substantially coincide with the outline of the rectangular surface and of the rectangularly shaped portions of the bearing blocks.

22. Apparatus according to claim 15 wherein rolls of at least some of the stands include a shaft, a plurality of die discs mounted on the shaft and rotatable about an axis thereof, means connected and rotating with the discs for varying a spacing between the discs so as to correspondingly vary the profile of the sheet being corrugated by the apparatus, and means biasing the discs in a direction parallel to the shaft axis towards each other.

23. Apparatus according to claim 22 wherein the varying means includes means for continuously varying the spacing between the discs over a predetermined range.

24. Apparatus according to claim 23 wherein the continuous varying means comprises a plurality of bolt means spaced about the shaft and connected to and rotating with the discs.

25. Apparatus according to claim 24 wherein the biasing means is defined by the bolt means, and including end collars mounted to the shaft proximate the respective bearing blocks therefor, wherein the bolt means extend substantially parallel to the shaft from one end collar via axially aligned apertures in the disc to the other end collar, means biasing the end collars with the bolts means towards the discs so as to bias the disc against each other, and further including threaded nut members for each disc carried by the bolt members for determining the relative position of the discs along the shaft.

26. Apparatus according to claim 25 including key means for securing at least some of the discs to the shaft for rotation of the former with the latter.

27. Apparatus according to claim 26 wherein at least some of the discs are rotatable relative to the shaft.

28. Apparatus according to claim 27 wherein the relatively rotatable discs comprise flanges mounted to the shaft, the threaded bolt means extending axially through the flanges, outer ring members disposed about the flanges, bearing means disposed between the flanges and the ring members permitting relative rotational movements between them, and means preventing relative axial movements between the flanges and the ring members.

29. In an apparatus for roll forming a flat sheet into a corrugated sheet having an undulating profile defined by alternating corrugation peaks and corrugation troughs each forming a generally concave surface and a parallel, generally convex surface, the apparatus including at least an upper forming roll disposed on one side of the sheet and a cooperating lower forming roll disposed on another side of the sheet, a first, generally disc shaped die having, in profile, a generally convexly shaped periphery and a relatively large maximum diameter, means for rotatably mounting the first die; a second, generally disc shaped die having, in profile, a generally concave periphery and a relatively smaller maximum diameter; means for rotatably mounting the second die in an axially spaced relation from the first die so that the peripheries of the dies, in profile, correspond to the desired shape of the convex and concave surfaces of the corrugated sheet and so that the dies rotate about parallel axes, the disc shaped dies being defined by pairs of opposing, disc shaped, axially spaced die halves; adjustable spacing means disposed between cooperating die halves and threadably engaging at least one of each pair of opposing die halves for selectively and continuously varying the spacing between such die halves; and means for power-rotating at least one of the disc shaped dies.

30. Apparatus according to claim 29 wherein the adjustable spacing means includes means adapted to indicate the axial distance between opposing, cooperating die halves.

31. Apparatus according to claim 29 wherein the adjustable spacing means comprises a threaded bolt having a head fixedly attached to the bolt and disposed intermediate the opposing cooperating die halves for axially moving such die halves with respect to each other by turning the head and thereby the bolt.

32. Apparatus according to claim 30 wherein the head is disposed intermediate the ends of the bolt, and wherein the bolt threadably engages each of the opposing die halves.

33. Apparatus for corrugating sheet metal comprising: a frame, a plurality of serially arranged corrugating stands mounted to the frame, each stand being defined by a pair of cooperating corrugating rows, the rows of at least one stand comprising a pair of spaced apart, parallel first and second shafts, and a plurality of generally disc shaped roll dies carried on each shaft, the roll dies being axially arranged over a portion of the length of each shaft and alternatingly defining a relatively large diameter convex roll die and a relatively smaller diameter concave roll die; at least one of the roll dies being defined by a disc mounted to the corresponding shaft, the disc including on its periphery a radially protruding lip; first and second die rings demountably applied over the periphery of the disc and defined by spaced apart, angularly shaped ring halves, the ring halves including grooves formed and arranged to engage the lip; means securing the ring halves to the disc; means biasing the ring halves towards each other and into engagement with the lip, whereby the interengagement of the grooves and the lip opposes forces acting on the rings in a generally axial direction during the corrugation of the sheet; and means for power-rotating at least some of the dies on at least one of the shafts of the one stand; whereby the sheet metal is grasped by opposing roll dies of the one stand and the power-rotated roll dies frictionally engage the sheet and advance it in a downstream direction, causing a deformation of the profile of the sheet as it passes between the rolls.

* * * * *